US008616981B1

(12) United States Patent
Guinn et al.

(10) Patent No.: US 8,616,981 B1
(45) Date of Patent: Dec. 31, 2013

(54) SYSTEMS, METHODS, AND DEVICES FOR PLAYING WAGERING GAMES WITH LOCATION-TRIGGERED GAME FEATURES

(71) Applicant: WMS Gaming Inc., Waukegan, IL (US)

(72) Inventors: Andrew C. Guinn, Chicago, IL (US); Jamie W. Vann, Chicago, IL (US); Pamela S. Smith, Chicago, IL (US); Daniel P. Louie, Chicago, IL (US); Jeremie D. Moll, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

(21) Appl. No.: 13/776,871

(22) Filed: Feb. 26, 2013

Related U.S. Application Data

(60) Provisional application No. 61/745,868, filed on Dec. 26, 2012, provisional application No. 61/700,028, filed on Sep. 12, 2012.

(51) Int. Cl.
*A63F 9/24* (2006.01)

(52) U.S. Cl.
USPC ..... 463/42; 463/16; 463/25; 463/31

(58) Field of Classification Search
USPC ..... 463/16–43; 273/191, 292, 143 R
See application file for complete search history.

(56) References Cited

U.S. PATENT DOCUMENTS 4,339,798 A 7/1982 Hedges et al.
4,455,025 A 6/1984 Itkis
4,527,798 A 7/1985 Siekierski et al.
4,624,459 A 11/1986 Kaufman
4,624,462 A 11/1986 Itkis
4,805,907 A 2/1989 Hagiwara
4,837,728 A 6/1989 Barrie et al.
4,842,278 A 6/1989 Markowicz
4,856,787 A 8/1989 Itkis
4,948,134 A 8/1990 Suttle et al.
5,102,138 A 4/1992 Johnson
5,116,055 A 5/1992 Tracy
5,249,800 A 10/1993 Hilgendorf et al.
5,275,400 A 1/1994 Weingardt et al.
5,280,909 A 1/1994 Tracy
5,299,803 A 4/1994 Halaby
5,344,144 A 9/1994 Canon
5,359,528 A 10/1994 Haendel et al.
5,365,451 A 11/1994 Wang et al.
5,377,973 A 1/1995 Jones et al.
5,393,057 A 2/1995 Marnell
5,397,133 A 3/1995 Penzias
5,470,079 A 11/1995 LeStrange et al.
5,489,103 A 2/1996 Okamoto (Continued)

*Primary Examiner* — Masud Ahmed
(74) *Attorney, Agent, or Firm* — Nixon Peabody LLP

(57) ABSTRACT

Gaming devices, gaming systems, methods of conducting wagering games, and computer programs for executing wagering games are disclosed. A gaming system for playing a wagering game is disclosed which includes one or more processors and one or more memory devices storing instructions that, when executed by at least one of the processors, cause the gaming system to: receive an indication of a physical location of a mobile computing device; determine if the physical location of the mobile computing device corresponds to or is within a predetermined proximity of a designated hotspot location; and, if so, determine a location-based gaming feature associated with the designated hotspot location and automatically triggering the location-based gaming feature without requiring an input from a user of the mobile computing device. Automatically triggering the location-based gaming feature includes, in some embodiments, initiating play of at least a portion of the wagering game.

20 Claims, 8 Drawing Sheets

(56) References Cited

U.S. PATENT DOCUMENTS

| | | | |
|---|---|---|---|
| 5,524,888 | A | 6/1996 | Heidel |
| 5,544,892 | A | 8/1996 | Breeding |
| 5,564,700 | A | 10/1996 | Celona |
| 5,580,063 | A | 12/1996 | Edwards |
| 5,580,309 | A | 12/1996 | Piechowiak et al. |
| 5,586,937 | A | 12/1996 | Menashe |
| 5,611,730 | A | 3/1997 | Weiss |
| 5,612,875 | A | 3/1997 | Haendel et al. |
| 5,618,232 | A | 4/1997 | Martin |
| 5,643,086 | A | 7/1997 | Alcorn et al. |
| 5,645,486 | A | 7/1997 | Nagao et al. |
| 5,655,961 | A | 8/1997 | Acres et al. |
| 5,674,128 | A | 10/1997 | Holch et al. |
| 5,707,286 | A | 1/1998 | Carlson |
| 5,759,102 | A | 6/1998 | Pease et al. |
| 5,762,552 | A | 6/1998 | Vuong et al. |
| 5,766,076 | A | 6/1998 | Pease et al. |
| 5,770,533 | A | 6/1998 | Franchi |
| 5,772,509 | A | 6/1998 | Weiss |
| 5,774,872 | A | 6/1998 | Golden et al. |
| RE35,864 | E | 7/1998 | Weingardt |
| 5,779,283 | A | 7/1998 | Kimura et al. |
| 5,779,549 | A | 7/1998 | Walker et al. |
| 5,797,794 | A | 8/1998 | Angell |
| 5,800,268 | A | 9/1998 | Molnick |
| 5,816,918 | A | 10/1998 | Kelly et al. |
| 5,823,874 | A | 10/1998 | Adams |
| 5,823,879 | A | 10/1998 | Goldberg et al. |
| 5,830,063 | A | 11/1998 | Byrne |
| 5,830,069 | A | 11/1998 | Soltesz et al. |
| 5,833,536 | A | 11/1998 | Davids et al. |
| 5,842,698 | A | 12/1998 | Brown |
| 5,848,932 | A | 12/1998 | Adams |
| 5,851,011 | A | 12/1998 | Lott |
| 5,851,149 | A | 12/1998 | Xidos et al. |
| 5,855,515 | A | 1/1999 | Pease et al. |
| 5,875,433 | A | 2/1999 | Francisco et al. |
| 5,876,284 | A | 3/1999 | Acres et al. |
| 5,885,158 | A | 3/1999 | Torango et al. |
| 5,909,486 | A | 6/1999 | Walker et al. |
| 5,921,865 | A | 7/1999 | Scagnelli et al. |
| 5,928,291 | A | 7/1999 | Jenkins et al. |
| 5,941,773 | A | 8/1999 | Harlick |
| 5,971,271 | A | 10/1999 | Wynn et al. |
| 5,971,849 | A | 10/1999 | Falciglia |
| 5,997,400 | A | 12/1999 | Seelig et al. |
| 6,001,016 | A | 12/1999 | Walker et al. |
| 6,004,205 | A | 12/1999 | Lauretta et al. |
| 6,007,427 | A | 12/1999 | Wiener et al. |
| 6,012,982 | A | 1/2000 | Piechowiak et al. |
| 6,012,983 | A | 1/2000 | Walker et al. |
| 6,012,984 | A | 1/2000 | Roseman |
| 6,016,479 | A | 1/2000 | Taricani |
| 6,026,433 | A | 2/2000 | D'Arlach et al. |
| 6,039,648 | A | 3/2000 | Guinn et al. |
| 6,047,963 | A | 4/2000 | Pierce et al. |
| 6,077,162 | A | 6/2000 | Weiss |
| 6,078,899 | A | 6/2000 | Francisco et al. |
| 6,089,977 | A | 7/2000 | Bennett |
| 6,089,980 | A | 7/2000 | Gauselmann |
| 6,102,474 | A | 8/2000 | Daley |
| 6,102,798 | A | 8/2000 | Bennett |
| 6,102,799 | A | 8/2000 | Stupak |
| 6,104,815 | A | 8/2000 | Alcorn et al. |
| 6,110,043 | A | 8/2000 | Olsen |
| 6,117,011 | A | 9/2000 | Lvov |
| 6,117,013 | A | 9/2000 | Eiba |
| 6,135,884 | A | 10/2000 | Hedrick et al. |
| 6,135,887 | A | 10/2000 | Pease et al. |
| 6,139,013 | A | 10/2000 | Pierce et al. |
| 6,142,872 | A | 11/2000 | Walker et al. |
| 6,146,273 | A | 11/2000 | Olsen |
| 6,149,522 | A | 11/2000 | Alcorn et al. |
| 6,154,172 | A | 11/2000 | Piccionelli et al. |
| 6,155,925 | A | 12/2000 | Giobbi et al. |
| 6,158,741 | A | 12/2000 | Koelling |
| 6,159,097 | A | 12/2000 | Gura |
| 6,164,651 | A | 12/2000 | Webb |
| 6,168,523 | B1 | 1/2001 | Piechowiak et al. |
| 6,183,362 | B1 | 2/2001 | Boushy |
| 6,183,366 | B1 | 2/2001 | Goldberg et al. |
| 6,203,010 | B1 | 3/2001 | Jorasch et al. |
| 6,204,560 | B1 | 3/2001 | Daetwyler et al. |
| 6,206,374 | B1 | 3/2001 | Jones |
| 6,206,782 | B1 | 3/2001 | Walker et al. |
| 6,210,274 | B1 | 4/2001 | Carlson |
| 6,210,275 | B1 | 4/2001 | Olsen |
| 6,210,277 | B1 | 4/2001 | Stefan |
| 6,217,448 | B1 | 4/2001 | Olsen |
| 6,220,593 | B1 | 4/2001 | Pierce et al. |
| 6,224,482 | B1 | 5/2001 | Bennett |
| 6,224,484 | B1 | 5/2001 | Okuda et al. |
| 6,231,445 | B1 | 5/2001 | Acres |
| 6,253,129 | B1 | 6/2001 | Jenkins et al. |
| 6,254,483 | B1 | 7/2001 | Acres |
| 6,264,557 | B1 | 7/2001 | Schneier et al. |
| 6,264,561 | B1 | 7/2001 | Saffari et al. |
| 6,270,410 | B1 | 8/2001 | DeMar et al. |
| 6,272,223 | B1 | 8/2001 | Carlson |
| 6,273,821 | B1 | 8/2001 | Moriguchi |
| 6,286,003 | B1 | 9/2001 | Muta |
| 6,308,953 | B1 | 10/2001 | Nagano |
| 6,309,299 | B1 | 10/2001 | Weiss |
| 6,312,332 | B1 | 11/2001 | Walker et al. |
| 6,315,660 | B1 | 11/2001 | DeMar et al. |
| 6,319,125 | B1 | 11/2001 | Acres |
| 6,319,127 | B1 | 11/2001 | Walker et al. |
| 6,334,104 | B1 | 12/2001 | Hirai |
| 6,336,859 | B2 | 1/2002 | Jones et al. |
| 6,336,862 | B1 | 1/2002 | Byrne |
| 6,345,824 | B1 | 2/2002 | Selitzky |
| 6,346,048 | B1 | 2/2002 | Ogawa et al. |
| 6,358,149 | B1 | 3/2002 | Schneider et al. |
| 6,361,441 | B1 | 3/2002 | Walker et al. |
| 6,364,768 | B1 | 4/2002 | Acres et al. |
| 6,375,567 | B1 | 4/2002 | Acres |
| 6,375,568 | B1 | 4/2002 | Roffman et al. |
| 6,402,618 | B1 | 6/2002 | Reed et al. |
| 6,406,371 | B1 | 6/2002 | Baba et al. |
| 6,409,602 | B1 | 6/2002 | Wiltshire et al. |
| 6,416,408 | B2 | 7/2002 | Tracy et al. |
| 6,416,409 | B1 | 7/2002 | Jordan |
| 6,422,940 | B1 | 7/2002 | Walker et al. |
| 6,431,983 | B2 | 8/2002 | Acres |
| 6,434,398 | B1 | 8/2002 | Inselberg |
| 6,435,968 | B1 | 8/2002 | Torango |
| 6,439,995 | B1 | 8/2002 | Hughs-Baird et al. |
| 6,454,650 | B1 | 9/2002 | Aronin |
| 6,482,089 | B2 | 11/2002 | DeMar et al. |
| 6,488,580 | B1 | 12/2002 | Robb |
| 6,488,585 | B1 | 12/2002 | Wells et al. |
| 6,503,146 | B2 | 1/2003 | Walker et al. |
| 6,506,117 | B2 | 1/2003 | DeMar et al. |
| 6,508,707 | B2 | 1/2003 | DeMar et al. |
| 6,508,709 | B1 | 1/2003 | Karmaker |
| 6,508,710 | B1 | 1/2003 | Paravia et al. |
| 6,517,073 | B1 | 2/2003 | Vancura |
| 6,517,433 | B2 | 2/2003 | Loose et al. |
| 6,520,855 | B2 | 2/2003 | DeMar et al. |
| 6,523,124 | B1 | 2/2003 | Lunsford et al. |
| 6,527,638 | B1 | 3/2003 | Walker et al. |
| 6,560,639 | B1 | 5/2003 | Dan et al. |
| 6,589,115 | B2 | 7/2003 | Walker et al. |
| 6,592,460 | B2 | 7/2003 | Torango |
| 6,599,186 | B1 | 7/2003 | Walker et al. |
| 6,599,188 | B2 | 7/2003 | Hirsch et al. |
| 6,599,193 | B2 | 7/2003 | Baerlocher et al. |
| 6,628,939 | B2 | 9/2003 | Paulsen |
| 6,648,753 | B1 | 11/2003 | Tracy et al. |
| 6,648,762 | B2 | 11/2003 | Walker et al. |
| 6,652,378 | B2 | 11/2003 | Cannon et al. |
| 6,665,715 | B1 | 12/2003 | Houri |
| 6,676,522 | B2 | 1/2004 | Rowe et al. |
| 6,682,421 | B1 | 1/2004 | Rowe et al. |

(56) References Cited

U.S. PATENT DOCUMENTS 6,692,354 B2 2/2004 Tracy et al.
6,712,695 B2 3/2004 Mothwurf et al.
6,712,699 B2 3/2004 Walker et al.
6,733,390 B2 5/2004 Walker et al.
6,749,510 B2 6/2004 Giobbi
6,755,741 B1 6/2004 Rafaeli
6,761,637 B2 7/2004 Weston et al.
6,790,141 B2 9/2004 Muir
6,800,029 B2 10/2004 Rowe et al.
6,805,634 B1 10/2004 Wells et al.
6,837,788 B2 1/2005 Cannon
6,837,793 B2 1/2005 McClintic
6,843,725 B2 1/2005 Nelson
6,846,238 B2 1/2005 Wells
6,860,810 B2 3/2005 Cannon et al.
6,869,361 B2 3/2005 Sharpless et al.
6,887,151 B2 5/2005 Leen et al.
6,923,724 B2 8/2005 Williams
6,935,952 B2 8/2005 Walker et al.
6,955,604 B1 10/2005 Graves et al.
6,971,956 B2 12/2005 Rowe et al.
6,986,055 B2 1/2006 Carlson
7,008,319 B2 3/2006 Montgomery et al.
7,083,520 B2 8/2006 Rowe
7,097,562 B2 8/2006 Gagner
7,169,041 B2 1/2007 Tessmer et al.
7,175,527 B2 2/2007 Bryant
7,192,351 B2 3/2007 Rozkin et al.
7,260,834 B1 8/2007 Carlson
7,311,598 B2 12/2007 Kaminkow et al.
7,311,604 B2 12/2007 Kaminkow et al.
7,331,868 B2 2/2008 Beaulieu et al.
7,347,775 B2 3/2008 Roemer
7,427,236 B2 9/2008 Kaminkow et al.
7,448,949 B2 11/2008 Kaminkow et al.
7,476,153 B2 1/2009 Walker et al.
7,510,474 B2 3/2009 Carter
7,534,169 B2 5/2009 Amaitis et al.
7,549,576 B2 6/2009 Alderucci et al.
7,637,810 B2 12/2009 Amaitis et al.
7,662,040 B2 2/2010 Englman et al.
7,666,092 B2 2/2010 Kaminkow et al.
7,722,466 B2 5/2010 Rothschild
7,775,873 B2 8/2010 Aoki et al.
7,780,531 B2 8/2010 Englman et al.
7,833,094 B2 11/2010 Englman et al.
7,854,654 B2 12/2010 Baerlocher et al.
7,892,093 B2 2/2011 Kniesteadt et al.
7,931,530 B2 4/2011 Anderson et al.
7,963,847 B2 6/2011 Baerlocher
7,980,954 B2 7/2011 Gagner et al.
8,152,634 B2 4/2012 Gagner et al.
8,216,048 B2 7/2012 Cowan et al.
8,262,456 B2 9/2012 Englman et al.
8,282,465 B2 10/2012 Giobbi
8,282,490 B2 * 10/2012 Arezina et al. ..... 463/42
8,292,731 B2 10/2012 Collette et al.
8,303,402 B2 11/2012 Aoki et al.
8,409,014 B2 4/2013 Gagner et al.
8,449,387 B2 5/2013 Englman et al.
2001/0004606 A1 6/2001 Tracy et al.
2001/0044339 A1 11/2001 Cordero et al.
2002/0002073 A1 1/2002 Montgomery et al.
2002/0006822 A1 1/2002 Krintzman
2002/0025845 A1 2/2002 Cannon
2002/0032049 A1 3/2002 Walker et al.
2002/0037767 A1 3/2002 Ebin
2002/0068631 A1 6/2002 Raverdy et al. ..... 463/42
2002/0073043 A1 6/2002 Herman et al.
2002/0086729 A1 7/2002 Emmerson et al. ..... 463/41
2002/0087876 A1 7/2002 Larose
2002/0098888 A1 7/2002 Rowe et al. ..... 463/39
2002/0107072 A1 8/2002 Giobbi
2002/0116615 A1 8/2002 Nguyen et al.
2002/0138594 A1 9/2002 Rowe
2002/0142846 A1 10/2002 Paulsen
2002/0147047 A1 10/2002 Letovsky ..... 463/42
2002/0147049 A1 10/2002 Carter, Sr. ..... 463/42
2002/0151345 A1 10/2002 Byrne
2002/0151349 A1 10/2002 Joshi
2002/0151363 A1 10/2002 Letovsky et al. ..... 463/40
2002/0155874 A1 10/2002 Byrne
2002/0155887 A1 10/2002 Criss-Puszkiewicz et al. . 463/29
2002/0163778 A1 11/2002 Hazzard et al.
2002/0183105 A1 12/2002 Cannon et al.
2002/0183107 A1 12/2002 Wolfe ..... 463/17
2003/0006931 A1 1/2003 Mages ..... 342/357.06
2003/0008703 A1 1/2003 Gauselmann ..... 463/20
2003/0027618 A1 2/2003 Byrne
2003/0028567 A1 2/2003 Carlson
2003/0032474 A1 2/2003 Kaminkow ..... 463/25
2003/0032485 A1 2/2003 Cockerille et al. ..... 463/43
2003/0036430 A1 2/2003 Cannon
2003/0045337 A1 3/2003 Byrne
2003/0050106 A1 3/2003 Lyfoung
2003/0054868 A1 3/2003 Paulsen et al. ..... 463/1
2003/0054878 A1 3/2003 Benoy et al. ..... 463/42
2003/0060258 A1 3/2003 Coleman et al.
2003/0064771 A1 4/2003 Morrow et al.
2003/0064776 A1 4/2003 Byrne
2003/0064805 A1 4/2003 Wells
2003/0064807 A1 4/2003 Walker et al.
2003/0092485 A1 5/2003 Seelig et al.
2003/0100361 A1 5/2003 Sharpless et al.
2003/0104865 A1 6/2003 Itkis et al. ..... 463/40
2003/0114220 A1 6/2003 McClintic
2003/0119581 A1 6/2003 Cannon et al.
2003/0130026 A1 7/2003 Breckner et al. ..... 463/20
2003/0139190 A1 7/2003 Steelberg et al. ..... 455/456
2003/0148804 A1 8/2003 Ikeya et al.
2003/0148807 A1 8/2003 Acres
2003/0148808 A1 8/2003 Price
2003/0162589 A1 8/2003 Nguyen et al.
2003/0181231 A1 9/2003 Vancura et al.
2003/0186733 A1 10/2003 Wolf et al.
2003/0195043 A1 10/2003 Shinners et al.
2003/0195841 A1 10/2003 Ginsberg et al. ..... 705/38
2003/0216166 A1 11/2003 Baerlocher et al.
2003/0222402 A1 12/2003 Olive
2003/0224852 A1 12/2003 Walker et al.
2003/0224855 A1 12/2003 Cunningham ..... 463/41
2003/0228899 A1 12/2003 Evans
2003/0232651 A1 12/2003 Huard et al. ..... 463/42
2003/0236116 A1 12/2003 Marks et al.
2004/0009808 A1 1/2004 Gauselmann
2004/0009811 A1 1/2004 Torango
2004/0030654 A1 2/2004 Walker et al.
2004/0038741 A1 2/2004 Gauselmann
2004/0048644 A1 3/2004 Gerrard et al.
2004/0053657 A1 3/2004 Fiden et al.
2004/0055113 A1 3/2004 Fiden et al.
2004/0087370 A1 5/2004 Tarantino ..... 463/42
2004/0102243 A1 5/2004 Olsen
2004/0106448 A1 6/2004 Gauselmann
2004/0137987 A1 7/2004 Nguyen et al. ..... 463/42
2004/0140989 A1 7/2004 Papageorge ..... 345/700
2004/0162124 A1 8/2004 Barton ..... 463/1
2004/0193431 A1 9/2004 Campbell ..... 705/1
2004/0204226 A1 10/2004 Foster et al.
2004/0204235 A1 10/2004 Walker et al.
2004/0209660 A1 10/2004 Carlson et al.
2004/0224769 A1 11/2004 Hansen et al. ..... 463/40
2004/0235552 A1 11/2004 Gauselmann
2004/0242297 A1 12/2004 Walker et al.
2004/0242303 A1 12/2004 Walker et al.
2004/0248651 A1 12/2004 Gagner
2005/0003883 A1 1/2005 Muir et al. ..... 463/16
2005/0009600 A1 1/2005 Rowe et al. ..... 463/29
2005/0014554 A1 1/2005 Walker et al.
2005/0020340 A1 1/2005 Cannon
2005/0026674 A1 2/2005 Wolf et al.
2005/0026697 A1 2/2005 Balahura et al. ..... 463/42
2005/0037708 A1 2/2005 Torvinen ..... 455/41.2
2005/0055113 A1 3/2005 Gauselmann

(56) References Cited

U.S. PATENT DOCUMENTS

| | | | | |
|---|---|---|---|---|
| 2005/0124406 | A1 | 6/2005 | Cannon | |
| 2005/0130728 | A1 | 6/2005 | Nguyen et al. | 463/16 |
| 2005/0130730 | A1 | 6/2005 | Lind et al. | |
| 2005/0187020 | A1 | 8/2005 | Amaitis et al. | |
| 2005/0192086 | A1 | 9/2005 | Walker et al. | |
| 2005/0193209 | A1 | 9/2005 | Saunders et al. | 713/182 |
| 2005/0197190 | A1 | 9/2005 | Amaitis et al. | 463/42 |
| 2005/0227770 | A1 | 10/2005 | Papulov | 463/42 |
| 2005/0282605 | A1 | 12/2005 | Englman | |
| 2006/0019734 | A1 | 1/2006 | Roemer | |
| 2006/0019744 | A1 | 1/2006 | Roemer | |
| 2006/0019745 | A1 | 1/2006 | Benbrahim | 463/29 |
| 2006/0035707 | A1 | 2/2006 | Nguyen et al. | 463/29 |
| 2006/0040732 | A1 | 2/2006 | Baerlocher et al. | |
| 2006/0079318 | A1 | 4/2006 | Aoki et al. | |
| 2006/0079319 | A1 | 4/2006 | Aoki et al. | |
| 2006/0084486 | A1 | 4/2006 | Belger et al. | |
| 2006/0121971 | A1 | 6/2006 | Slomiany et al. | |
| 2006/0135243 | A1 | 6/2006 | Englman | |
| 2006/0160625 | A1 | 7/2006 | Englman et al. | |
| 2006/0165235 | A1 | 7/2006 | Carlson | |
| 2006/0189382 | A1 | 8/2006 | Muir et al. | 463/29 |
| 2006/0223611 | A1 | 10/2006 | Baerlocher | |
| 2007/0021198 | A1 | 1/2007 | Muir et al. | 463/29 |
| 2007/0054739 | A1 | 3/2007 | Amaitis et al. | 463/42 |
| 2007/0060305 | A1 | 3/2007 | Amaitis et al. | 463/25 |
| 2007/0060306 | A1 | 3/2007 | Amaitis et al. | 463/25 |
| 2007/0060355 | A1 | 3/2007 | Amaitis et al. | 463/40 |
| 2007/0060358 | A1* | 3/2007 | Amaitis et al. | 463/42 |
| 2007/0066401 | A1 | 3/2007 | Amaitis et al. | 463/42 |
| 2007/0066402 | A1 | 3/2007 | Amaitis et al. | 463/42 |
| 2007/0275779 | A1 | 11/2007 | Amaitis et al. | |
| 2007/0281782 | A1 | 12/2007 | Amaitis et al. | |
| 2007/0281785 | A1 | 12/2007 | Amaitis et al. | |
| 2007/0281792 | A1 | 12/2007 | Amaitis et al. | |
| 2008/0020847 | A1 | 1/2008 | Kniesteadt et al. | |
| 2008/0045341 | A1 | 2/2008 | Englman | |
| 2008/0070702 | A1 | 3/2008 | Kaminkow et al. | |
| 2008/0076572 | A1* | 3/2008 | Nguyen et al. | 463/42 |
| 2008/0081690 | A1 | 4/2008 | Baerlocher et al. | |
| 2008/0113771 | A1 | 5/2008 | Baerlocher et al. | |
| 2008/0139290 | A1 | 6/2008 | Kniesteadt et al. | |
| 2008/0153564 | A1 | 6/2008 | Baerlocher et al. | |
| 2008/0300046 | A1 | 12/2008 | Gagner et al. | |
| 2008/0311994 | A1 | 12/2008 | Amaitis et al. | |
| 2009/0093298 | A1 | 4/2009 | Michel | |
| 2009/0124366 | A1 | 5/2009 | Aoki et al. | |
| 2009/0162245 | A1 | 6/2009 | Rasmussen | |
| 2009/0170596 | A1 | 7/2009 | Gagner et al. | |
| 2009/0170597 | A1 | 7/2009 | Bone et al. | |
| 2009/0176559 | A1 | 7/2009 | Buchholz et al. | |
| 2009/0197684 | A1* | 8/2009 | Arezina et al. | 463/42 |
| 2009/0280910 | A1 | 11/2009 | Gagner et al. | |
| 2009/0305765 | A1 | 12/2009 | Walker et al. | |
| 2010/0016075 | A1 | 1/2010 | Thomas | |
| 2010/0137047 | A1 | 6/2010 | Englman et al. | |
| 2010/0197385 | A1 | 8/2010 | Aoki et al. | |
| 2010/0291991 | A1 | 11/2010 | Baerlocher et al. | |
| 2010/0304843 | A1 | 12/2010 | Aoki et al. | |
| 2011/0053683 | A1 | 3/2011 | Aoki et al. | |
| 2011/0105233 | A1 | 5/2011 | Aoki | |
| 2011/0312410 | A1 | 12/2011 | Aoki et al. | |
| 2012/0214571 | A1* | 8/2012 | Oakes et al. | 463/17 |
| 2012/0276990 | A1* | 11/2012 | Arezina et al. | 463/29 |
| 2013/0116028 | A1 | 5/2013 | Aoki et al. | |
| 2013/0217473 | A1* | 8/2013 | Oakes et al. | 463/25 |
| 2013/0237304 | A1* | 9/2013 | Oakes et al. | 463/16 |

* cited by examiner

SYSTEMS, METHODS, AND DEVICES FOR PLAYING WAGERING GAMES WITH LOCATION-TRIGGERED GAME FEATURES

CLAIM OF PRIORITY AND CROSS-REFERENCE TO RELATED APPLICATIONS

This application claims the benefit of and priority to U.S. Provisional Patent Application No. 61/745,868, which was filed on Dec. 26, 2012, and U.S. Provisional Patent Application No. 61/700,028, which was filed on Sep. 12, 2012, both of which are incorporated herein by reference in their respective entireties.

COPYRIGHT

A portion of the disclosure of this patent document contains material which is subject to copyright protection. The copyright owner has no objection to the facsimile reproduction by anyone of the patent disclosure as it appears in the U.S. Patent and Trademark Office patent files or records, but otherwise reserves all copyright rights whatsoever.

TECHNICAL FIELD

The present disclosure relates generally to wagering games, as well as wagering game terminals and gaming systems. More particularly, aspects of the present disclosure relate to systems, methods, computer programs, and devices for playing wagering games with game features that are triggered by the location of a mobile gaming device.

BACKGROUND

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Thus, gaming manufacturers continuously strive to develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "primary" or "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio.

Another concept that has been employed is the use of progressive jackpots. In the gaming industry, a "progressive jackpot" involves collecting coin-in data from participating gaming device(s), such as slot machines, contributing a percentage of that coin-in data to a jackpot amount, and awarding that jackpot amount to a player upon the occurrence of a jackpot-winning event. A jackpot-winning event typically occurs when a "progressive winning position" is achieved at a participating gaming device. If the gaming device is a slot machine, a progressive winning position may, for example, correspond to alignment of progressive jackpot reel symbols along an active payline. The initial progressive jackpot is a predetermined minimum amount. That jackpot amount, however, progressively increases as players continue to play the gaming machine without winning the jackpot. Further, when several gaming machines are linked together such that several players at several gaming machines compete for the same jackpot, the jackpot progressively increases at a much faster rate.

Interactive online gaming allows players to gamble from locations remote from casinos and other traditional gaming establishments. For example, a player may access a gaming web site on a global computer network, such as the Internet, from a computing device communicatively coupled to the global computer network. The computing device may, for example, be a personal computer, Internet appliance, personal digital assistant (PDA), or wireless telephone (i.e., "cell phones"). In a typical online wagering game scenario, a player must first acquire internet connectivity, open a web browser on their computing device, access the host website, navigate the website to locate the desired wagering game, and supply personal and financial information (e.g., credit or debit card account information) before the player is permitted to engage in any wagering activity. Wagers are then deducted from the player's account, and payouts for winning outcomes are added to the account. Additional information regarding online gaming can be found, for example, in commonly owned U.S. Pat. No. 7,722,466 B2, to Wayne H. Rothschild, which issued on May 25, 2010, and is incorporated herein by reference in its entirety and for all purposes.

The processes and interfaces required for online gaming can oftentimes be confusing and time consuming to the player. Moreover, the player must wait until they are granted access by the host website before they are permitted to engage in any online wagering game activities. There are also security risks associated with conducting electronic transactions over the internet, especially when the player is accessing a new and unfamiliar host website. These issues are exacerbated by gaming conducted wirelessly with portable computing and cellular devices, such as PDA's, tablets, and smartphones, which typically have less processing power, reduced internet connectivity, smaller display screens, and smaller QWERTY keyboards than their desktop counterparts, and are more susceptible to theft and tampering than personal desktop computers. For the foregoing and other reasons, there is a need for improved online and wireless gaming features that reduce the complexity and time required to engage in game play, provide enhanced security protection, and/or are more amenable to gaming conducted wirelessly with portable computing and cellular devices. Such new features will further enhance player excitement, perpetuate player loyalty, and thus increase game play and profitability to hosts and operators.

SUMMARY

Aspects of the present disclosure are directed to wagering games with location-based gaming features that are automatically triggered or otherwise activated by the location and/or relative proximity of a mobile gaming device carried by a player. In one representative implementation, a dedicated software application is provided for a user's portable computing device or handheld cellular device. The dedicated software application can be configured to display a map with indicators of local "hotspots" within a predetermined surrounding area of the user. Each of these hotspots represents a distinct location-based gaming feature. As one example, each location-based gaming feature is a specific reel-spin-triggering event for a slot-type wagering game. When the user, and thus the user's portable computing device/handheld cellular device, is physically located at or is determined to be within a predetermined proximity of a hotspot, the dedicated software application will automatically initiate the corresponding reel-spin-triggering event. In some embodiments, the reel-spin-triggering event is initiated without requiring an input from the user. In this instance, the dedicated software application may alert the user when the reel-spin-triggering event is initiated. Optionally, a player may initiate the reel-spin-triggering event, for example, by "checking in" at a hotspot location. In this instance, the location-based feature would then be triggered automatically upon check-in but, in some embodiments, it would not automatically trigger as soon as the hotspot is detected. The reel-spin-triggering event may operate to provide the player with a randomly determined outcome of the slot game.

In accord with an optional configuration, the user's outcome for the play of the slot-type wagering game can be compared to the outcomes for other user's at that hotspot or within a predetermined proximity of that hotspot. In this regard, the user's outcome can be added to a leader board. Optionally, the outcome of that individual game can be tied to an online social network game, such as those offered by FACEBOOK®. In this regard, the leader board can be posted and viewed on the social network website, and the user can be awarded with bonus games or game enhancements (sometimes referred to as "power ups") for use with the online social network game depending, for example, on the how long the user remains at the top of the leader board. This same concept can be applied to group gameplay where a team of users collects location-based gaming features and, for example, the outcomes of all of the collected spins of the team during a specified period are posted to a group/team leader board.

According to one aspect of the present disclosure, a gaming system is disclosed for conducting a wagering game with a mobile computing device. The mobile computing device is configured to wirelessly communicate information with the gaming system via a network. The gaming system includes one or more processors and one or more memory devices. The memory device(s) stores instructions that, when executed by at least one of the one or more processors, cause the gaming system to: receive an indication of a physical location of the mobile computing device; determine if the physical location of the mobile computing device corresponds to or is within a predetermined proximity of a designated hotspot location; and, responsive to the physical location of the mobile computing device corresponding to or being within the predetermined proximity of the designated hotspot location, determine a location-based gaming feature associated with the designated hotspot location and automatically trigger the location-based gaming feature without requiring an input from a user of the mobile computing device. Automatically triggering the location-based gaming feature includes initiating play of at least a portion of the wagering game.

In accordance with another aspect of the disclosure, one or more physical non-transitory machine-readable storage media are featured which include instructions which, when executed by one or more processors, cause the one or more processors to perform operations comprising: receive an indication of a physical location of a mobile computing device configured to wirelessly communicate information with a gaming system configured to conduct a wagering game; determine if the physical location of the mobile computing device corresponds to or is within a predetermined proximity of a designated hotspot location; and, responsive to the physical location of the mobile computing device corresponding to or being within the predetermined proximity of the designated hotspot location: determine a location-based gaming feature associated with the designated hotspot location, and automatically trigger the location-based gaming feature without requiring an input from a user of the mobile computing device. Automatically triggering the location-based gaming feature includes initiating play of at least a portion of the wagering game.

Other aspects of the present disclosure are directed to a computer-implemented method of conducting a wagering game with a mobile computing device configured to wirelessly communicate information with a gaming system. The method includes: receiving an indication of a physical location of the mobile computing device; determining if the physical location of the mobile computing device corresponds to or is within a predetermined proximity of a designated hotspot location; and, responsive to the physical location of the mobile computing device corresponding to or being within the predetermined proximity of the designated hotspot location: determining a location-based gaming feature associated with the designated hotspot location, and automatically triggering the location-based gaming feature without requiring an input from a user of the mobile computing device. Automatically triggering the location-based gaming feature includes initiating play of at least a portion of the wagering game.

Another aspect of this disclosure is directed to a computer-implemented method of conducting a wagering game with a mobile computing device configured to wirelessly communicate information with a gaming system. The method includes: receiving from a user player information to create a player account; storing in a database the player account associated with an indicator of the mobile computing device; providing to the user a dedicated, standalone software application operable to download to the mobile computing device; storing in a database a list of designated hotspots, a respective location of each of the designated hotspots, and a location-based gaming feature associated with each of the designated hotspots on the list of designated hotspots; determining if a physical location of the mobile computing device corresponds to or is within a predetermined proximity of at least one of the designated hotspot locations; responsive to the physical location of the mobile computing device corresponding to or being within the predetermined proximity of at least one of the designated hotspot locations, automatically triggering, without user input, the location-based gaming feature corresponding to the at least one of the designated hotspot locations, wherein automatically triggering the location-based gaming feature includes initiating play of at least a portion of the wagering game; outputting a notification to the mobile computing device that the location-based gaming feature was automatically triggered; and receiving, via the dedicated, standalone software application, a redemption input from the user to view a randomly determined outcome of the play of the wagering game and to redeem any awards associated therewith.

The above summary is not intended to represent each embodiment or every aspect of the present disclosure. Rather, the summary merely provides an exemplification of some of the novel features presented herein. The above features and advantages, and other features and advantages of the present disclosure, will be readily apparent from the following detailed description of exemplary embodiments and modes for carrying out the present invention when taken in connection with the accompanying drawings and the appended claims.

Figure 1:
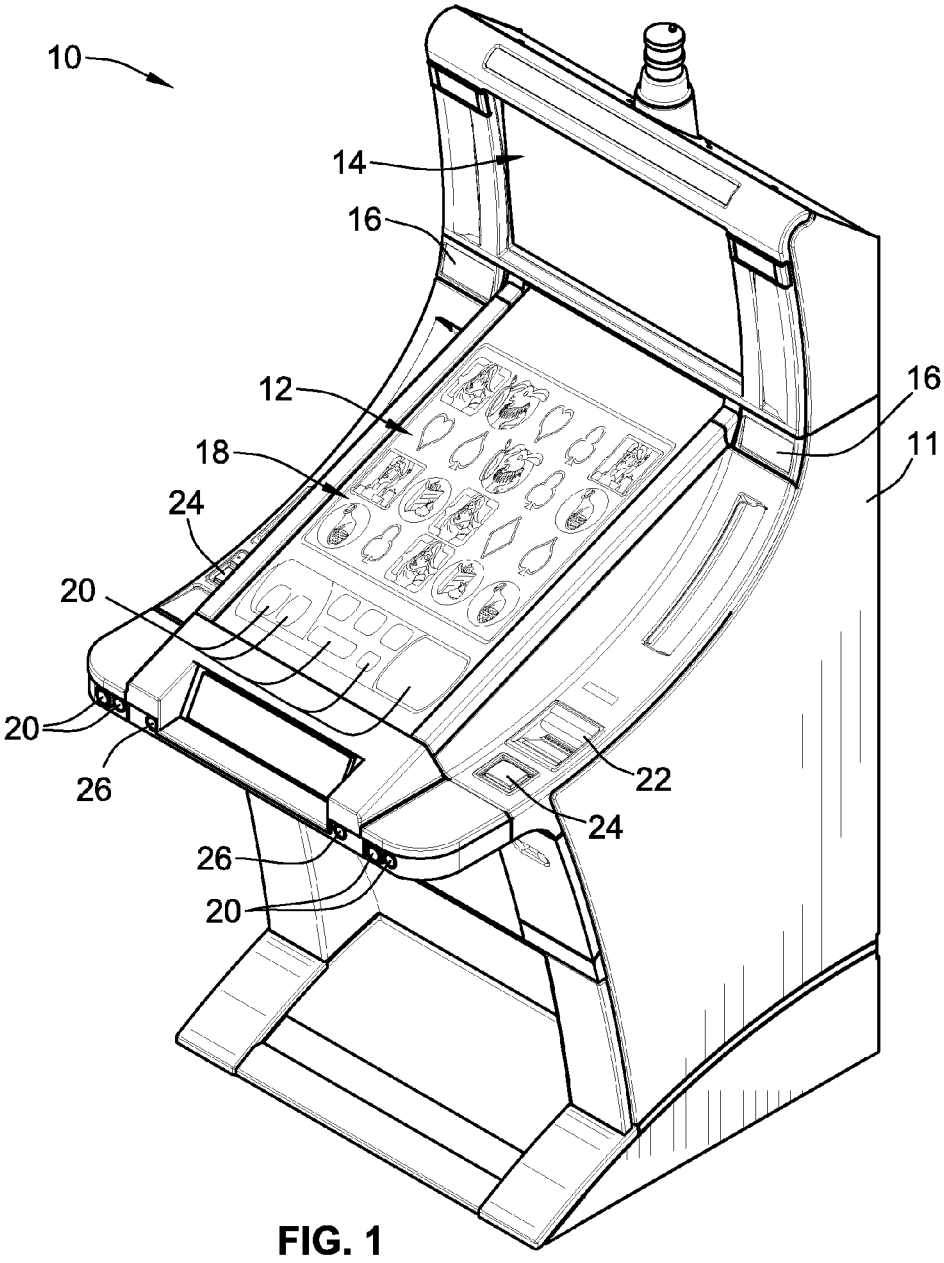
FIG. 1 is a perspective-view illustration of an example of a free-standing gaming terminal according to aspects of the present disclosure.

While aspects of this disclosure are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

This invention is susceptible of embodiment in many different forms. There are shown in the drawings and will herein be described in detail representative embodiments of the invention with the understanding that the present disclosure is to be considered as an exemplification of the principles of the invention and is not intended to limit the broad aspects of the invention to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed: the singular includes the plural and vice versa; the words "and" and "or" shall be both conjunctive and disjunctive; the word "all" means "any and all"; the word "any" means "any and all"; and the words "including" and "comprising" mean "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example.

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to the drawings, wherein like reference numerals refer to like features throughout the several views, there is shown in FIG. 1 a representative gaming terminal 10 similar to those used in gaming establishments, such as casinos, hotels and cruise ships, and non-conventional gaming establishments, such as airports and restaurants. With regard to the present disclosure, the gaming terminal 10 may be any type of gaming terminal and may have varying structures and methods of operation. For example, in some aspects, the gaming terminal 10 is an electromechanical gaming terminal configured to play slots with mechanical reels, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models (as shown), handheld mobile devices, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433, U.S. Patent Application Publication Nos. 2010/0069160 and 2010/0234099, and International Application No. PCT/US2007/000792, all of which are incorporated herein by reference in their respective entireties for all purposes.

The gaming terminal 10 illustrated in FIG. 1 comprises a cabinet 11 that may house various input devices, output devices, and input/output devices. By way of non-limiting example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display may be disposed in front of the mechanical-reel display to portray a video image superimposed upon the mechanical-reel display. The display areas may variously display information associated with wagering games, non-wagering games, community games, progressive games, advertisements, services, premium entertainment, text messaging, emails, alerts, announcements, broadcast information, subscription information, etc., appropriate to the particular mode(s) of operation of the gaming terminal 10. The gaming terminal 10 includes a touch screen(s) 18 mounted over the primary and/or secondary areas 12, 14, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals can be selected from a group consisting essentially of an electrical current, an electrical voltage, an electrical charge, an optical signal, an optical element, a magnetic signal, and a magnetic element.

Figure 2:
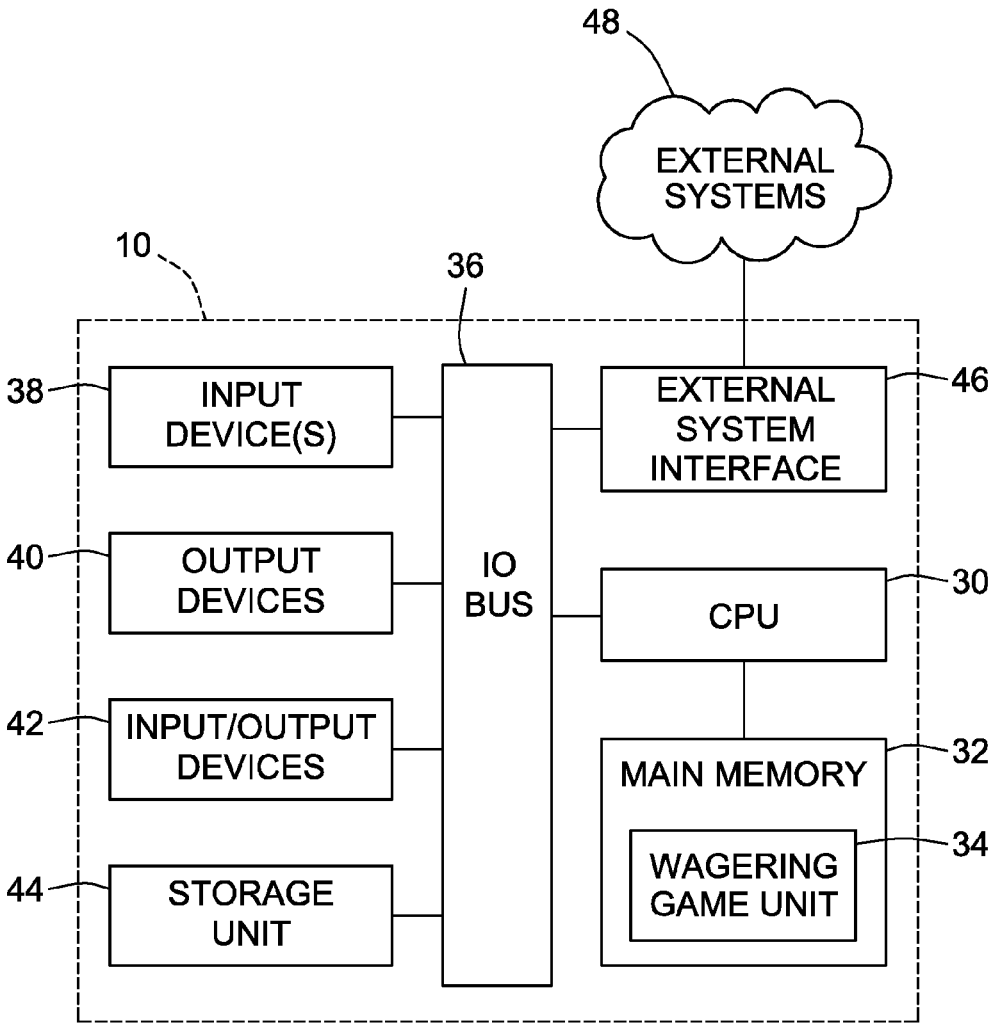
FIG. 2 is a schematic diagram of an example of a gaming system according to aspects of the present disclosure.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes a random number generator (RNG) for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
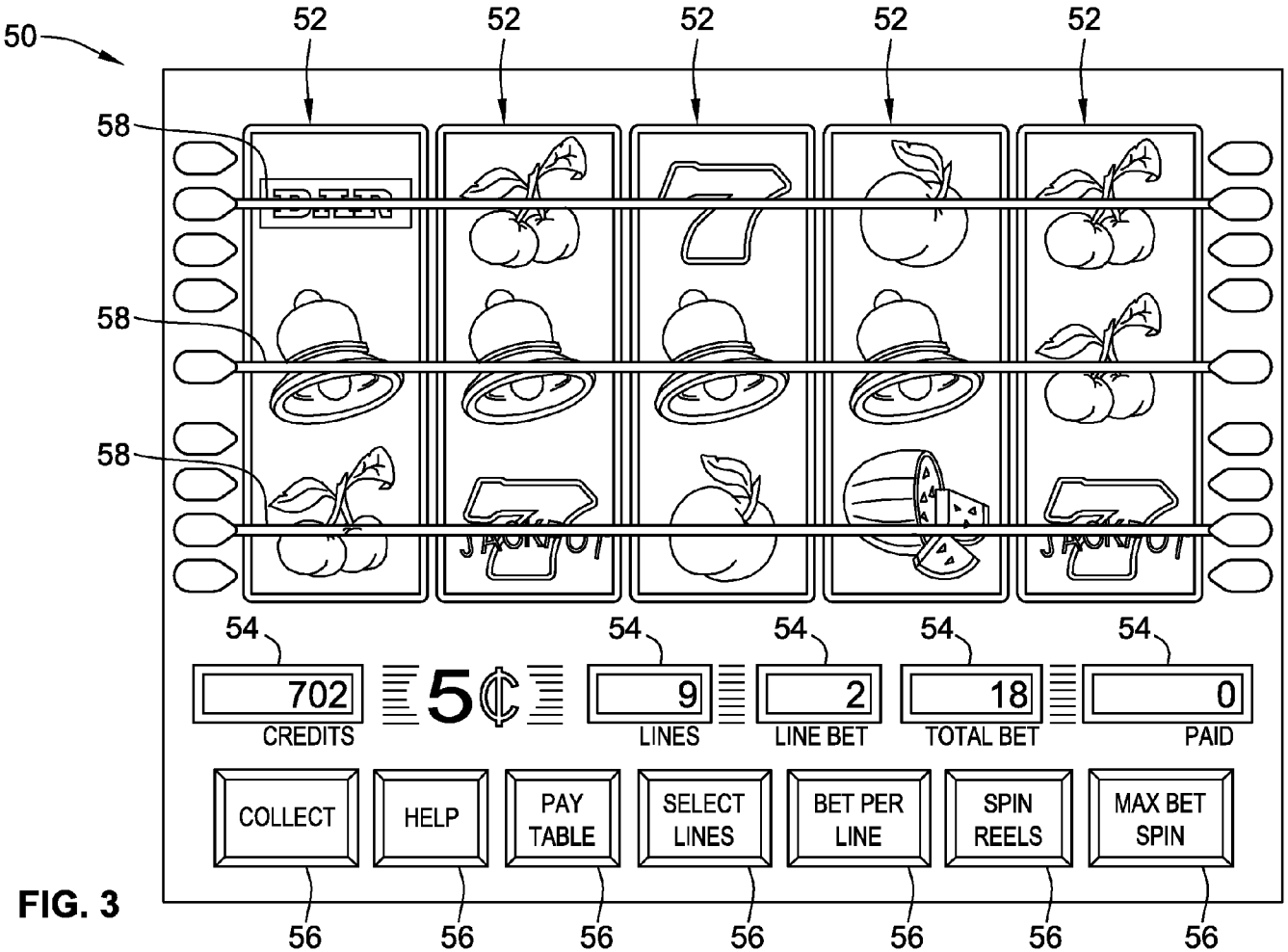
FIG. 3 is a screen shot of a representative basic-game screen of a wagering game displayed on a gaming terminal, gaming device, and/or gaming system according to aspects of the present disclosure.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by an RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
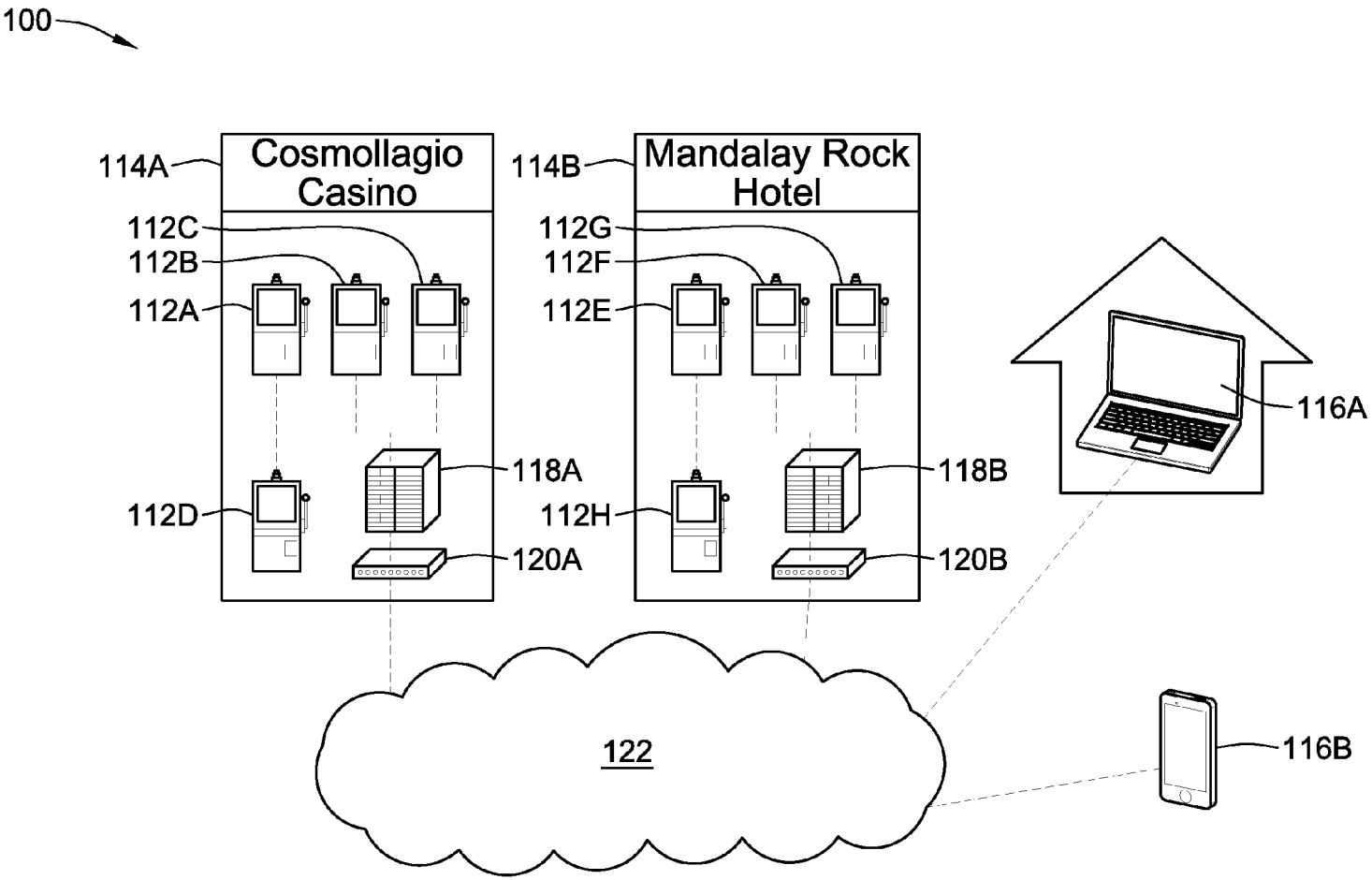
FIG. 4 is a diagrammatic illustration of a representative gaming system and network for providing wireless location-based gaming in accordance with aspects of the present disclosure.

FIG. 4 is a diagrammatic illustration of a representative gaming system and network with which aspects of the disclosed concepts can be practiced. The gaming system and network, which are collectively designated 100 in the drawings, may be a web-based system or other system configuration for integrating casino gaming with non-casino interactive gaming, and vice versa. The gaming system and network 100 can be a wired or a wireless system, or a combination of wired and wireless technology. In at least some aspects, most if not all of the interactive gaming functions described herein can be conducted over a wireless network, such as a WLAN or cellular data network, to ensure freedom of movement of the user and the user's portable wireless computing device. In various aspects, the portable wireless computing devices include a web browser or a dedicated, standalone software application, or a combination of both. In some embodiments, a user manually requests a web page from a host wagering game server. In addition, or as an optional alternative, the dedicated software application automatically makes requests with the web browser.

As shown, the gaming system and network 100 includes a first plurality of gaming terminals 112A-D located in a first "land-based" or "brick-and-mortar" gaming establishment 114A (e.g., the "Cosmollagio Casino"), and a second plurality of gaming terminals 112E-H located in a second "land-based" or "brick-and-mortar" gaming establishment 114B (e.g., the "Mandalay Rock Hotel"). Also included are a variety of personal mobile computing devices, represented herein by a laptop computer 116A and a mobile phone with a built-in mobile computing platform (or "smartphone") 116B, which are remote from either of the gaming establishments 114A and 114B. Each of the gaming establishments 114A-B utilizes a local "casino" server 218A and 118B, respectively, which is communicatively coupled to a corresponding communications hub 120A, 120B. The local servers 118A-B individually, collectively and/or in collaboration with an offsite central server system (not shown), can offer a plurality of wagering games in such categories as slots, poker, bingo, keno, and blackjack, just to name a few examples.

The land-based gaming establishments 114A-B, including one or more of the gaming terminals 112A-H, are shown linked to the mobile computing devices 116A-B by a reconfigurable, multi-site computer network 122, such as an intranet, an extranet, the Internet, or a combination thereof. The mobile computing devices 116A-B, which are remote from any land-based gaming establishment, may communicatively connect, with proper authorization, to one or more of the local servers 118A-B and/or gaming terminals 112A-H via the network 122. In so doing, one or more of the wagering games that are available on the local servers 118A-118B may be conducted via either the gaming terminals 112A-H and/or or the mobile computing devices 116A-B. Although differing in appearance, the gaming terminals 112A-H can be similar in function and connectivity to the gaming terminal 10 discussed above with respect to FIGS. 1 and 2. The gaming terminals 112A-H of FIG. 4 can take on various configurations, including free standing gaming machines, handheld gaming machines, countertop gaming machines, personal computers or laptop computers, or any combination thereof.

The network 122 may be a network based on TCP/IP (Transmission Control Protocol/Internet Protocol) protocols belonging to an organization, such as a corporation or other legal business entity, accessible only by the organization's members, employees, and/or others with proper authorization. In the illustrated system, the network 122 can be used to securely network the gaming terminals 112A-H to a local casino server 218A-B and other terminals, both inside and outside of their respective establishments 114A-B. Each of the local servers 118A-B can operate a host web site and post wagering games on the web site. The web site can include a firewall to fend off unauthorized access. With proper authorization, the non-casino-based mobile computing devices 116A-B may access the web page(s) via the network 122 and thereby link to the local casino servers 118A-118B and even the gaming terminals 112A-H. As will be developed in further detail below, the network 122 can also be used to automatically trigger location-based gaming features on the mobile computing devices 116A-B.

Communication can take place through any now-known or hereinafter developed media, such as telephone lines (e.g., Dial-Up), local area network (LAN) or wide area network (WAN) links (e.g., Ethernet, T(X) lines, X.25, etc.), broadband connections (e.g., Integrated Service Data Network (ISDN), Frame Relay, etc.), wireless links (e.g., infrared, Bluetooth®, WiFi or WLAN), cellular networks, and so on. The network 122, in at least some embodiments, can typically carry TCP/IP protocol communications, and HTTP/HTTPS requests made by a web browser and associated responses and replies, and the connection between client software and a server can be communicated over such TCP/IP networks. Some non-limiting examples of networks that can serve as the communications network 122 include a wireless or wired Ethernet-based intranet, a local or wide-area network (LAN or WAN), and/or the global communications network known as the Internet, which can be configured to accommodate many different communications media and protocols.

When a wagering game is conducted via one of the gaming terminal 112A-H, the wagering game may be conducted at a server level, a terminal level, or a hybrid server/terminal level depending, for example, upon how the machine and the system are set up. Likewise, when a wagering game is conducted via one of the mobile computing device 116A-B, the wagering game may be conducted at a server level or a hybrid server/device level depending, for example, upon how the device and the system are set up. When the wagering game is conducted at the server level, the game's audiovisual content and game software are executed, for example, at one of the local casino servers 118A-118B. In this case, the gaming terminals 112A-H and/or mobile computing devices 116A-B need not include a game engine for executing the game software and primarily serve as a display device. To allow the terminals 112A-H and/or computing devices 116A-B to execute the audiovisual content and game software, this information is downloaded or otherwise communicated from a local casino server 218A-B to the terminal 112A-H or device 116A-B and stored locally prior for conducting the wagering game. When the wagering game is conducted at the hybrid level, the audiovisual content is executed at the terminal 112A-H or device 116A-B while the game software is executed at the server 218A-118B. To allow the terminal 112A-H or device 116A-B to execute the audiovisual content, the audiovisual content is downloaded from the server 218A-118B and stored locally on the gaming device prior to conducting the wagering game. In order to make wagering games conducted via a mobile computing device 116A-B verifiable, it may be required that the random event be generated at the server 218A-B. Thus, in some embodiments, wagering games may not be conducted solely at the device level. Other embodiments may be configured to offer this functionality.

The gaming terminals 112A-H can also be networked to each other and a server 218A-B by the network 122. The gaming terminals 112A-H in each land-based gaming establishment 114A-B can be linked by a high-speed local area network, such as a wireless or wired Ethernet. Each local area network can be configured to support standard Internet protocols, such as TCP/IP, for transmitting data over the local area network and transmitting data between the local area network and a local system 118A-B. The local casino server 218A-B may include a gateway that serves as an entrance to the local area network. The gateway can be associated with a router, which knows where to direct a given packet of data that arrives at the gateway, and a switch, which furnishes the actual path in and out of the gateway for a given packet. The communications hub 120A-B can consolidate data transferred to and from the gaming terminals 112A-H. A workstation (not shown) may be used to program, control, and/or monitor the gaming terminals 112A-H at the local casino level.

As indicated above, the mobile computing devices 116A-B can include dedicated, standalone application software (e.g., a mobile app) to conduct any or all of the herein disclosed location-based gaming features. The dedicated application software can be implemented in various forms. For instance, the dedicated application software can be in the form of a web-based (e.g., Java) applet that is downloaded to the mobile computing device and runs in conjunction with a web browser on the mobile computing device. Optionally, the dedicated application software can be in the form of a standalone software application, which can be implemented in a multi-platform language such as .Net or Java, or in native processor executable code. If executed on the mobile computing devices 116A-B, the dedicated application software can be operable to open a network connection with the gaming servers over the communications network 122 and, thus, communicates via that connection with the servers 118A, 118B. In some embodiments, the dedicated application software communicates with a single "host" or "client" server, which in turn conducts any necessary communications with one or more "third party" servers to complete a particular transaction. Optionally, the dedicated application software and web browser can be part of a single client-server interface, where the software can be implemented as a "plug-in" to the web browser, for example. Other optional variations and known alternatives are considered to be within the scope and spirit of the present disclosure.

Figure 5:
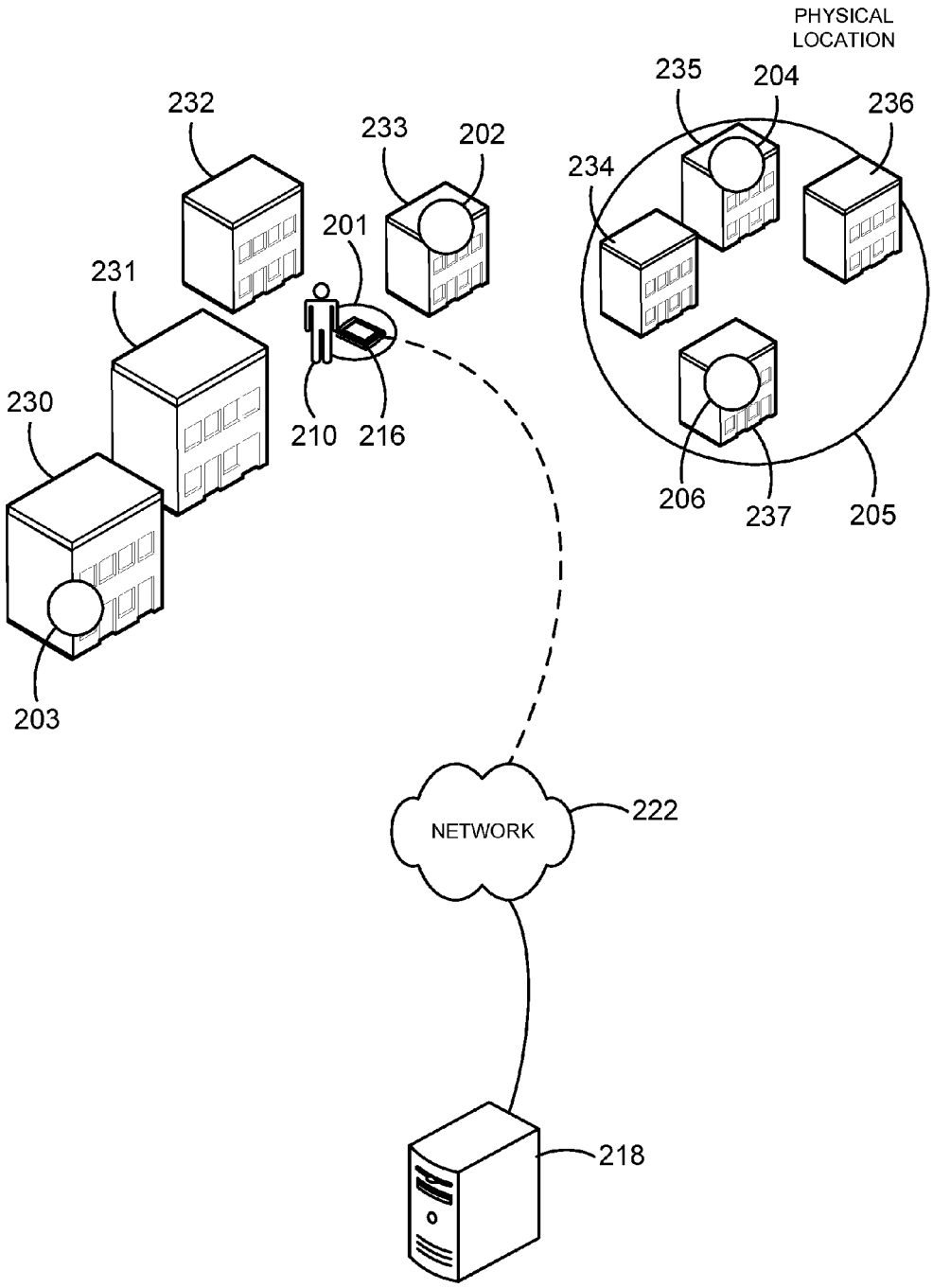
FIG. 5 is a diagrammatic illustration of another representative gaming system and network for providing wireless location-based gaming in accordance with aspects of the present disclosure.

FIG. 5, like FIG. 4, is a diagrammatic illustration of a representative gaming system and network, designated generally as 200, for providing wireless location-based gaming features in accordance with aspects of the present disclosure. The gaming system and network 200 of FIG. 5 provides location-based wagering features for wagering games that are triggered based on the physical location and/or relative proximity of a handheld mobile gaming device. Although differing in appearance, the gaming system and network 200 of FIG. 5, as well as the gaming systems and networks 300 and 400 of FIGS. 6 and 7, respectively, which will be discussed in detail below, can include any of the features, options, and alternatives discussed above with respect to the gaming systems of FIGS. 2 and 4, and vice versa. In this regard, the gaming systems and networks disclosed herein can be constituent parts (i.e., subsystems) of the same gaming system and network.

Referring now to FIG. 5, wherein like reference numerals refer to like components from the other views, the gaming system 200 includes a wagering game server 218 that exchanges information with a mobile computing device 216 via a network 222. For instance, the mobile computing device (also referred to herein as "mobile device" or "gaming device") 216 and the wagering game server 218 are communicatively coupled together through the network 222. In this example, the mobile device 216 can function as a handheld wagering game machine. The mobile device 216 can take on various forms, including a laptop computer, a smartphone (e.g., the Apple IPHONE or the Samsung GALAXY S III), a personal digital assistant (PDA) (e.g., the HP IPAQ 210 ENTERPRISE Handheld PDA or the PALM TUNGSTEN E2 Handheld PDA), a tablet computer (e.g., the Samsung GALAXY TAB tablet device and the Apple IPAD tablet device), and an e-reader (e.g., the KINDLE electronic reader device), as some non-limiting examples. It may be desirable, in some preferred embodiments, for the mobile device 216 to be an internet-capable cellular-enabled device. In some embodiments, the mobile device 216 can download location-specific wagering game content from the wagering game server 218. In some other embodiments, the mobile device 216 can have the location-specific wagering game content stored in local machine-readable media, thereby not requiring the content be downloaded. The mobile device 216 is associated with a user 210. The user 210 can be a wagering game player playing wagering games on the mobile device 216. In some preferred embodiments, the location-based gaming features are configured to trigger even when the user 210 is not actively playing a wagering game on the mobile device 216. In this regard, the player may not even need to be aware that the location-based gaming features will be triggered or has been triggered.

FIG. 5 also depicts a number of geographic locations—e.g., buildings 230-237—that can represent store fronts for different business entities. While shown as being near or in buildings, the designated hotspot locations can be near or in other locations, such as public parks, cities, various landmarks in a city, etc. Moreover, the hotspots need not be a stationary location, such as a building or business, but could be a moving hotspot, such as another mobile device. FIG. 5 also depicts designated hotspot locations 201-206 (which may also be referred to herein as "hotspots" or "designated locations"). In FIG. 5, the first hotspot location 201 is positioned near but external to the buildings 232 and 236. The first hotspot location 201 is associated with one or more of the business entities in the buildings 232 and 236. The second hotspot location 202 is positioned within the building 233, and can therefore be associated with one or more business entities in the building 233. The third hotspot location 203 is positioned within the building 230, and can therefore be associated with one or more business entities in the building 233. In a similar regard, the fourth hotspot location 204 is positioned within the building 235, and can thus be associated with one or more business entities in the building 235. Likewise, the fifth hotspot location 205 is positioned to include (e.g., is within a predetermined proximity of) the buildings 234-237 and some portions external to the buildings 234-237. The fifth hotspot location 205 is associated with one or more business entities in the buildings 234-237. The sixth hotspot location 206 is positioned within the building 237, and can therefore be associated with the business entity in the building 237.

In the illustrated example, the user 210 and the mobile computing device 216 are positioned in range of the first hotspot location 201, so that one or more location-based gaming features associated with that hotspot location 201 are available. For example, when the player is located at the first hotspot location 201, one or more of the location-based gaming features associated with the business entities in the buildings 232 and 233 can be automatically triggered on the mobile computing device 216. As the user 210 moves with the mobile computing device 216 to different geographic locations, one or more location-based gaming features associated with the other hotspot locations become available. For example, when the user 210 moves the mobile computing device 216 in range of the second hotspot location 202, one or more of the location-based gaming features associated with the second hotspot location 202 can be triggered (e.g., a distinct reel-spin-triggering event associated with a business entity in the building 233 is automatically triggered without user input). When the user moves the mobile computing device 216 in range of the third hotspot location 203, one or more of the location-based gaming features associated with the third hotspot location 203 are automatically triggered, and so on for all the buildings shown in FIG. 5.

As shown, the size of a designated hotspot location can vary. For example, the hotspot location can be a defined as the area inside or around a building, or both. This can include large buildings (e.g., a baseball stadium or mall) and defined perimeters around large business entities. The hotspot location can also cover a number of buildings associated with different business entities. The hotspot location can also include a location near a number of business entities. For example, the hotspot location can include a park outside a shopping center.

Location and movement of the mobile computing device 216 can be tracked via a location tracking device which can reside in the mobile computing device 216. The location can be determined, for example, through a satellite-based global positioning system (GPS) navigation feature. Even without a GPS receiver, the mobile computing device 216 can provide location and movement information through cooperation with a cellular system through a process known as "trilateration." A cellular system's towers and base stations communicate radio signals and are arranged into a network of cells. A cellular device, such as cellphones, smartphones and cellular-enabled tablet computers, have low-power transmitters for communicating with the nearest tower, base station, router, or access point. As a user moves with the cellular device, e.g., from one cell to another, the base stations monitor the strength of the transmitter's signal. When the cellular device moves toward the edge of one cell, the transmitter signal strength diminishes for a current tower. At the same time, the base station in the approaching cell detects a strength increase in the signal. As the user moves into a new cell, the towers transfer the signal from one to the next. A computer can determine the location of the device based on measurements of the transmitter signal, such as the angle of approach to the cell tower(s), the time it takes the signal to travel to multiple towers, and the strength of the signal when it reaches the towers.

According to other aspects of at least some embodiments of the present concepts, a movement sensor can be provided comprising one or more sensors configured to determine the movement (e.g., rotation, translation, etc.) of the mobile computing device 216 with respect to an established datum or reference (e.g., position, spatial orientation, reaction, force, velocity, acceleration, electrical contact, etc.) about or along one or more axes. In yet some other embodiments, a near field communication (NFC) tag, radio-frequency identification (RFID) tag, Bluetooth® or WiFi (wireless fidelity) transmitted code, etc., carried by or otherwise emitted from the mobile computing device 216 can trigger/initiate a location-based gaming feature. As another possible option, the user 210 can use their mobile computing device 216 to acquire and submit documentation of their presence at a particular location to trigger a location-based gaming feature—e.g., by taking a picture of that particular location or an item (e.g., a Quick Response (QR) Code) at that particular location.

In general, the location-based gaming features affect the play of a wagering game. In one example, a dedicated software application is provided for the user's mobile computing device 216. The dedicated software application is configured to display a map (e.g., which may look similar to what is shown in the top-half of FIG. 5) with indicators of designated local "hotspots" 201-206 within a predetermined surrounding area and/or a predetermined vicinity of the user 210. Each of these hotspots 201-206 represents a distinct location-based gaming feature. As one example, each location-based gaming feature is a specific reel-spin-triggering event for a slot-type wagering game. For instance, when the user 210 is within range of the second hotspot 202, which is positioned within the building 233, at least one of the one or more location-based gaming features associated with at least one of the one or more business entities in the building 233 is automatically triggered. The dedicated software application on the user's mobile computing device 216 will automatically initiate the corresponding reel-spin-triggering event. In some embodiments, the reel-spin-triggering event is initiated without requiring an input from the user. In this instance, the dedicated software application may alert the user when the reel-spin-triggering event is initiated. The reel-spin-triggering event may operate to provide the player with a randomly determined outcome of the slot game.

The following is an example with reference to the hotspot locations 204-206. A business entity in the building 234 can be associated with (e.g., sponsor) one or more different wagering games for the fifth hotspot location 205. A business entity in the building 235 can be associated with one or more different wagering games for the hotspot location 205. A different business entity in that same building 235 can also be associated with one or more wagering games for the fourth hotspot location 204. Moreover, another business entity in the building 236 can be associated with one or more different "sponsored" wagering games for the fifth hotspot location 205. Yet another business entity, which is located in the building 237, can be associated with one or more wagering games for the hotspot location 205. A different business entity in the building 237 can also be associated with altered wagering game content for two different wagering games for the hotspot location 206. The sponsored wagering game(s) associated with each of the foregoing entities may be the same as, similar to and/or interactive with one, some or all of the wagering games sponsored by the other entities. Optionally, one or more of the sponsored wagering game(s) associated with each of the foregoing entities may be completely different from and/or independent of some or all of the wagering games sponsored by the other entities.

Accordingly, in some embodiments, a person can select from multiple wagering games having location-based gaming content for some hotspot locations. The person can make their selection, for example, based on prizes awarded. For example, assume the user 210 moves their mobile computing device 216 into the fifth hotspot location 205. The user 210 can initiate a mobile device dedicated software application (more commonly known as an "app" or "mobile app") on the mobile computing device 216. The mobile computing device 216 can then present a list of wagering games available for the hotspot location 205 on its display. The mobile computing device 216 can also display the location and/or entity associated with each of the available wagering games. The mobile computing device 216 can further display the available prizes for the wagering games that are available to play. The user 210 can then select which wagering game or games to play using an input control on the mobile computing device 216. For example, the user 210 can select a wagering game associated with the business entity in the building 234 because the prizes include coupons for products or services for that business entity.

In some embodiments, the awards for game play triggered via movement of the mobile computing device 216 can affect subsequent game play at a brick-and-mortar wagering game establishment. By way of non-limiting example, the award for game play triggered via movement of the mobile computing device 216 can include an award multiplier and/or an additional payout for a winning outcome in a play of a wagering game at a wagering game machine at a brick-and-mortar wagering game establishment. To illustrate, assume the user 210 is awarded a win in the outcome of the play of a wagering game triggered by a location-based gaming feature. The mobile computing device 216 can then transmit a notification to the wagering game server 218 regarding the additional payout for a win at a wagering game machine at a brick-and-mortar wagering game establishment. The wagering game server 218 can make a corresponding update to a player account associated with the user 210. Subsequently, when the user 210 has a winning result at a particular wagering game machine (e.g., a wagering game machine having the same theme as the wagering game played on the mobile computing device 216), an additional award is provided to the user as a result of the win in the outcome of the play of a wagering game triggered by a location-based gaming feature. The additional award can be sponsored by a business entity at or near the hotspot location which triggered the location-based gaming feature. Such an embodiment incentivizes players to wager at the brick-and-mortar wagering game establishment after playing location-based wagering games. While described in reference to wagering games conducted on a physical gaming machine located at a brick-and-mortar wagering game establishment, this example is also applicable to online wagering games.

The location-based gaming features disclosed herein can also affect other aspects of the wagering game. For example, the location-based gaming feature can affect aspects of the game's presentation (e.g., images, video, audio, etc.). To illustrate, if the wagering game is a slot game, one or more of the reel symbols can be modified to indicate or otherwise represent the hotspot location. For example, as indicated above, the hotspot locations can be associated with a business entity, a government entity, a non-profit entity, a geographic location, etc. In such configurations, the location-based gaming feature can include graphics or images representing the associated business entity, government entity, non-profit entity, geographic location, etc.

In some embodiments, the mobile computing device 216 is not required to be within the area defined as the hotspot location (e.g., the mobile computing device 216 need not be inside the building or store of the business entity associated with that hotspot location) to trigger a corresponding location-based gaming feature. Rather if the mobile computing device 216 is within a predetermined range or proximity of a designated hotspot location, the location-based gaming features corresponding thereto are available. Aspects of a location-based gaming feature can vary based on the mobile device's proximity to the designated hotspot location. In some embodiments, the closer the mobile computing device 216 is to a designated hotspot location, the greater the potential awards associated with any game play triggered by the location-based gaming feature.

Figure 6:
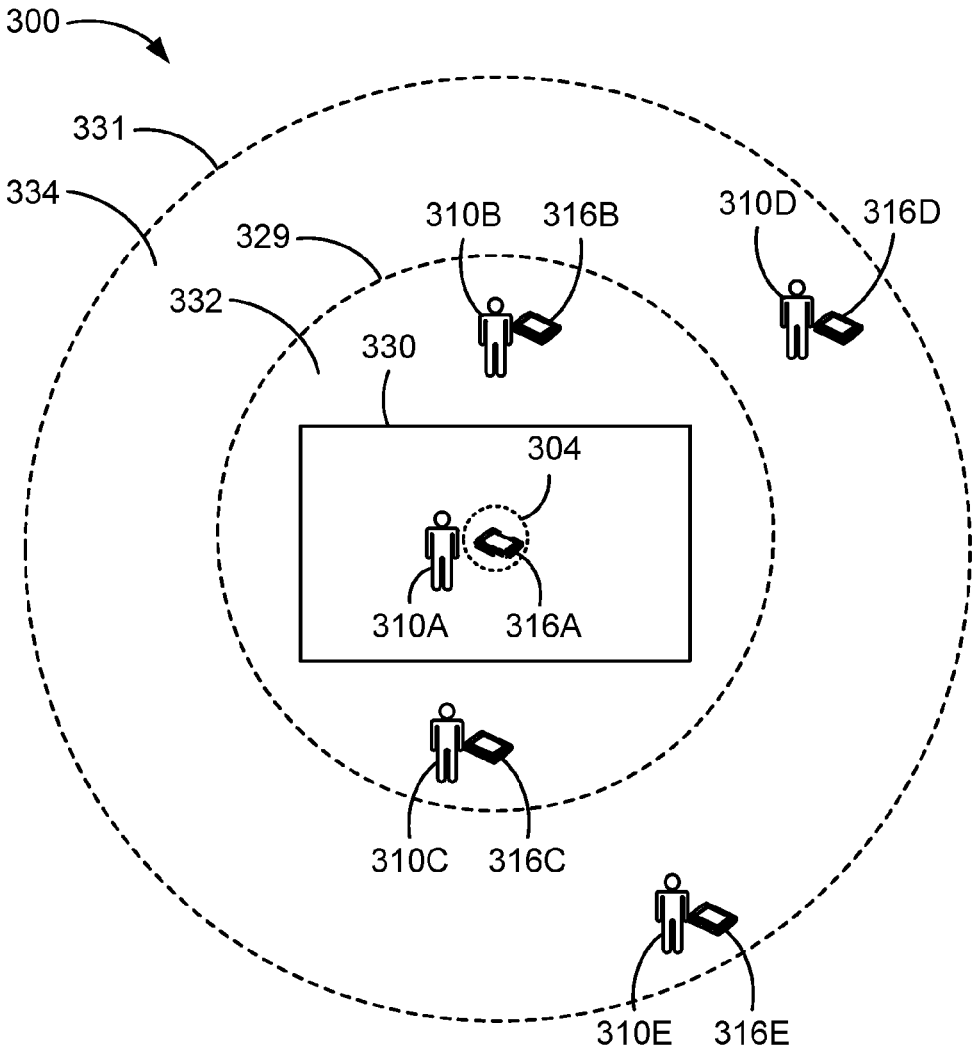
FIG. 6 is a diagrammatic illustration of yet another representative gaming system and network for providing wireless location-based gaming in accordance with aspects of the present disclosure

FIG. 6, wherein like reference numerals refer to like components from the other views, depicts a representative gaming system 300 that is wirelessly communicating with five different users 310A-E via five respective mobile computing devices 316A-E. The first user 310A is shown standing inside the location (e.g., building 330) of a designated hotspot 304 which may be a store front, a mall, a stadium, a government building, etc. FIG. 6 also depicts two areas—a first area designated generally as 332 and a second area designated generally as 334—that radiate outward from the designated hotspot 304. The two illustrated areas 332, 334 can be considered to define two distinct "playable areas". In particular, the first area 332 includes the area between the ring defining the designated hotspot 304 and the ring 329, whereas the second area 334 includes an area between the ring 329 and an outer ring 331. At least one of the one or more location-based gaming features associated with the designated hotspot location 304 is available on the mobile computing devices 316B-E even though these devices are outside the physical location (i.e., the building 330) of the designated hotspot location 304. In particular, the location-based gaming feature(s) is available as long as the mobile devices are within the second outermost area 334.

In some embodiments, the first user 310A is eligible for a first location-based gaming feature or a first set of location-based gaming features because the user's mobile computing device 316A is inside the building 330 of the designated hotspot 304. The second user 310B, on the other hand, may be restricted to a second location-based gaming feature, which may be less valuable than the first location-based gaming feature, or a second set of location-based gaming features, which may include some but not all of the location-based gaming features in the first set, because the mobile computing device 316B of the second user 310B is within the first area 332 but not within the location of the designated hotspot 304. In the illustrated example, the third user 310C is also eligible for the second location-based gaming feature and/or the second set of location-based gaming features because the mobile computing device 316C of the third user 310C, even though further away from the building 330 than the mobile computing device 316B, is within the first area 332. Likewise, the fourth user 310D may be restricted to a third location-based gaming feature, which may be less valuable than the first and second location-based gaming features, or a third set of location-based gaming features, which may include some but not all of the location-based gaming features in the second set, because the mobile computing device 316D of the fourth user 310D is within the second area 334 but not within the location of the designated hotspot 304 or within the first area 332. The fifth user 310E is also eligible for the third location-based gaming feature and/or the third set of location-based gaming features because the mobile computing device 316E of the fifth user 310E is within the second area 334.

In this example, prizes can vary based on a mobile computing device's proximity to the designated hotspot 304. In some embodiments, the closer the mobile device is to the designated hotspot 304, the greater the available prizes. For example, because the mobile computing device 316A is within the location 330 of the designated hotspot 304, the first user 310A can win prizes that are at least $50. Because the mobile devices 316B and 316C are outside the location 330 of the designated hotspot 304, but within the first area 332, the second and third users can win prizes that are between $25 and $50. In the same vein, because the mobile devices 316D and 316E are beyond the first area 332, but within the second area 334, the fourth and fifth users 310D and 310E can win prizes that are up to $25. If a mobile device is outside the second area 334, the user of that device is not eligible for any of the location-based gaming features associated with the designated hotspot 304. Such a configuration incentivizes persons to be closer to the designated hotspot 304, which could cause the persons to buy products and services from the business entity in the building 330.

Figure 7:
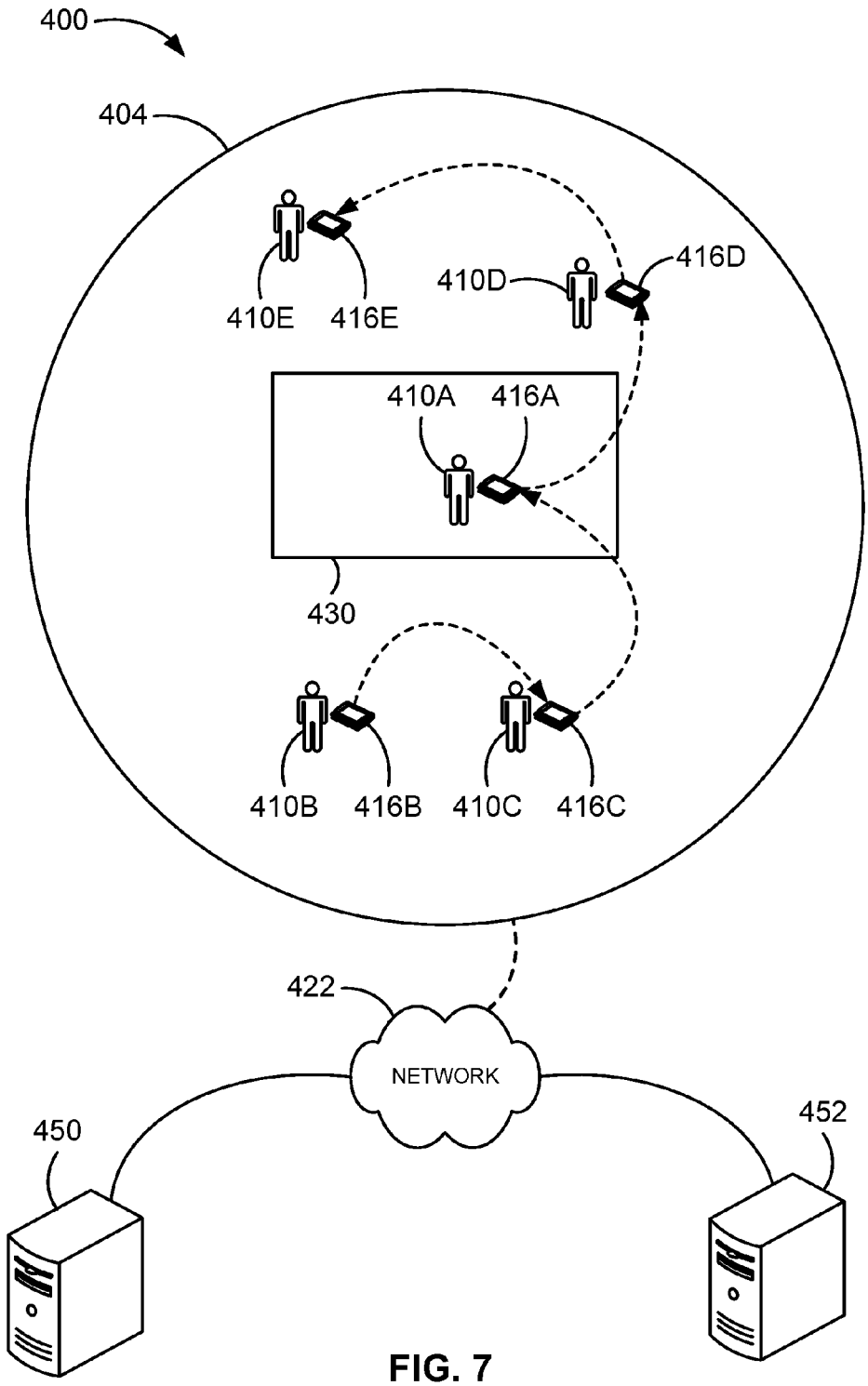
FIG. 7 is a diagrammatic illustration of even yet another representative gaming system and network for providing wireless location-based gaming in accordance with aspects of the present disclosure.

Some embodiments incorporate a social network gaming component into the location-based wagering game features. FIG. 7, for example, depicts a gaming system that provides location-based gaming features for wagering games that have a social network gaming component. In the wagering game industry, social gaming typically refers to gaming environments which allow multiple players to play wagering games as a way of social interaction, as opposed to individual players playing a game in isolation. Many social network games are played over the Internet and are available as turn-based models that are seamlessly integrated into widely popular social networking websites, such as FACEBOOK®, SECOND LIFE®, and TWITTER®. Social network games are most often implemented as "browser games," played over the Internet with a web browser employing standard web technologies or browser plugins. Even though social network games are often played via a web browser, they are distinct from traditional "browser games," for example, by leveraging a player's social graph and individual user data that is hosted on a particular social network website.

FIG. 7, like FIGS. 4, 5 and 6, is a diagrammatic illustration of a representative gaming system and network, designated generally as 400, for providing wireless location-based gaming features in accordance with aspects of the present disclosure. FIG. 7 depicts a system 400 wherein a social network game is played by a group of users over a social network. A group win of the social game occurs, in accord with at least some of the disclosed concepts, when a defined number of persons achieve a winning result in a play of a social game that is triggered, at least in part, by a location-based gaming feature enabled on their mobile computing devices. That is, to achieve a group win, each person in a social network group must achieve a winning result in a play of a social game that is triggered, at least in part, by a location-based gaming feature. The group win can include a shared award that is sponsored, at least in part, by a business entity associated with a designated hotspot. For example, if the business entity is a professional sports team, the award can include tickets for a stadium suite for a game.

The gaming system 400 of FIG. 7 is wirelessly communicating over the network 422 with five different users 410A-E via five respective mobile computing devices 416A-E. The gaming system 400 is also operatively connected to a designated hotspot 404 that surrounds a business establishment 430. The system 400 includes a wagering game server 450 and a social network server 452, each of which may be similar in form and functionality to the servers and/or controllers described above, that communicate with the mobile devices 416A-E through the network 422. The business establishment 430 can take on any of the various forms discussed hereinabove, including a coffee shop or a restaurant. As shown, all five users 410A-E have their respective mobile computing devices 416A-E within the designated hotspot 404 area.

In FIG. 7, the users 410A-E are part of a group within a social network (e.g., FACEBOOK®). For example, the users 410A-E can be a defined group of "Facebook friends." FIG. 7 shows how some embodiments employ player forwarding (see dotted arrow begging at 416B) to provide access to the social component of the wagering game. After a user achieves a winning result in a play of a social wagering game triggered by a location-based gaming feature, the user initiates an operation to cause their computing mobile device to transmit a notification to another user in their social networking group that has not yet achieved a winning result (i.e., player forwarding). The player forwarding continues until each user in the group has achieved a winning result for the social component of the wagering game. After each person in the group has achieved a winning result, a group win is awarded to the members of the group.

In FIG. 7, the second user 410B using the mobile computing device 416B is provided initial access to a wagering game with the social network component. The mobile computing device 416B may obtain initial access through a random determination. For example, the user 410B can initiate a dedicated mobile software application on the mobile computing device 416B to view the available wagering games based on the current location of the mobile device 416B. The mobile device 416B can wirelessly communicate with the wagering game server 450. The wagering game server 450 can make a random determination and transmit the result to the mobile device 416B. If the mobile computing device 416B is selected, the dedicated mobile software application can provide a wagering game having a social component to the mobile device 416B. The mobile application may download the wagering game content for the social component from the wagering game server 450 and/or retrieve it from a local machine-readable storage device in the mobile computing device 416B.

Also, the mobile application on the mobile computing device 416B can communicate with the social network server 452 using an Application Programming Interface (API). The mobile application can access a player account for the second user 410B for the social network being hosted by the social network server 452. The mobile application can retrieve a list of groups from the account of the second user 410B. The mobile application can then randomly select a group that is to be part of the social game. Alternatively, the user 410B can be presented an option to select a group from their social network. Alternatively, the user 410B can create a group on their social network. After the group is selected or created, the persons within the group can then have the option to play the wagering game having the social component. Also, wagering can include wagering of real money, "fun" money, or anything else of real or perceived value on an event with an uncertain outcome. For example, the wagering could be based on a virtual currency, where the wagering games are played for fun. In such an example, the rewards could be discounts for services or products for a business entity.

In FIG. 7, after a location-based gaming feature is activated by the location of the mobile computing device 416B and the user 410B achieves a winning result in the play of the social game which was triggered, at least in part, by the location-based gaming feature, the user 410B causes the mobile computing device 416B to send (or the system 400 automatically generates) a notification to the mobile computing device 416C. The third user 410C then plays the wagering game until there is a winning result for the social component. After a location-based gaming feature is triggered by the location of the mobile computing device 416C and the user 410C achieves a winning result, a notification is sent to the mobile computing device 416A. This process continues until all of the users 410A-E achieve a winning result for the social component. After the last user (e.g., the fifth user 410E in FIG. 7) achieves a winning result, a group win is awarded to the members of the group.

In some embodiments, the mobile computing devices 416A-E do not send notifications to each other. Instead, after a mobile device achieves a winning result, the mobile device transmits a communication to the social network server 452. For example, a mobile device may post a notification on the wall of at least one member in the group who has not yet achieved a winning result for the wagering game. Also, as each winning result is achieved and/or after the group win is awarded, the mobile device can post a notification on the wall of each member of the group in the social network.

It should be readily understood that the gaming systems illustrated in the drawings are merely provided as exemplary applications by which the various inventive aspects and features of this disclosure can be applied. Moreover, only selected components of the systems have been shown and are described in detail. Nevertheless, the systems and devices discussed herein can include numerous additional and alternative features, and other well-known peripheral components, for example, for carrying out the various methods and functions disclosed herein. Those components which are well-known and/or are not necessary for carrying out the aspects of the present disclosure will not be described in further detail.

The various features and aspects of the present disclosure are not per se limited to slot games; these features and aspects can be applied to many different types of wagering games that can be formatted to operate in accordance with the disclosed concepts. Some non-limiting examples include applying the disclosed location-based gaming features to bonus games, progressive games, community games, etc.

Figure 8:
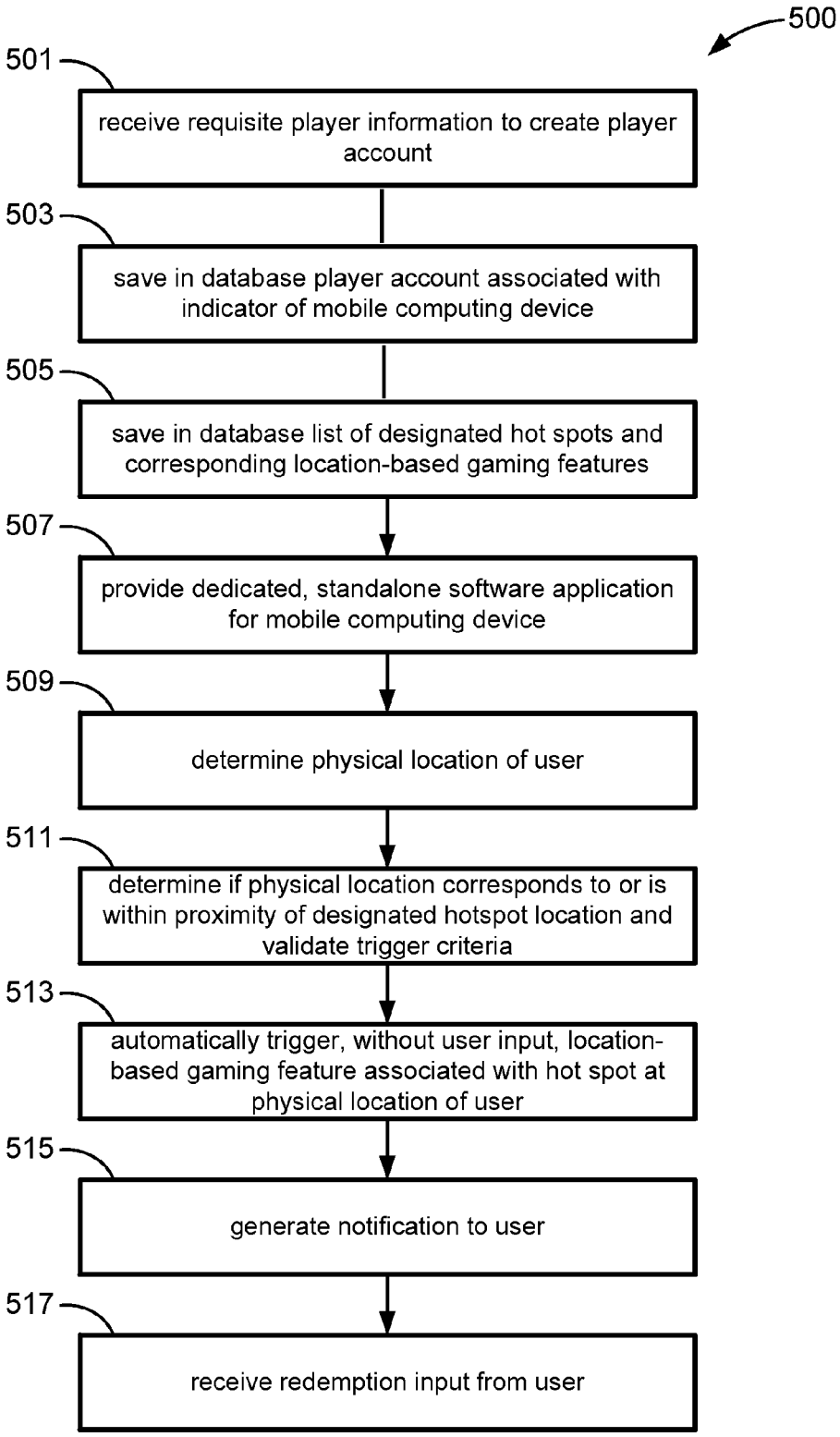
FIG. 8 is a flowchart for an exemplary method or algorithm that can correspond to instructions that can be stored on one or more non-transitory computer-readable media and can be executed by one or more controllers in accord with aspects of the disclosed concepts.

With reference now to the flow chart of FIG. 8, an improved method for conducting a wagering game with a mobile computing device that is configured to wirelessly communicate information with a gaming system, such as the systems shown in FIGS. 4-7, is generally described at 500 in accordance with aspects of the present disclosure. FIG. 8 can be representative of an algorithm that corresponds to at least some instructions that can be stored, for example, in main memory 32 of FIG. 2, and executed, for example, by the CPU 30 and/or external system(s) 48 of FIG. 2 to perform any or all of the above or below described functions associated with the disclosed concepts. The method 500 will be described with reference to the various aspects and features shown in FIGS. 4-7 of the drawings; such reference is being provided purely by way of explanation and clarification.

The method 500 starts at block 501 by receiving information from a user that is required to create a player account for that user. Such information may include, in any combination, the user's name, mailing address, billing address, billing information (e.g., credit card number or checking account information), a user ID, a password, player preferences, etc. Once received, block 501 may also include creating a player account and, at block 503, contemporaneously storing the player account and corresponding information in a database. The player account, when stored, may be associated with the user's mobile computing device. For instance, the player account may be stored in association with the device's serial number, Internet Protocol (IP) address, or any other functional indicator of the user's mobile computing device. Block 501 could also be optional, for example, in instances where a user already has a preexisting player account. A user may be enrolled in a gaming establishment's loyalty club (e.g., PLAYER'S LIFE™ available from WMS Gaming Inc.). As another example, the user may have already provided the requisite information to one of the business entities sponsoring one or more of the designated hotspots (e.g., to open a My Starbucks Rewards™ STARBUCKS® loyalty card). In such an instance, the method 500 may include requesting and importing player account information from a third party.

At block 505, the method 500 includes storing in a database a list of designated hotspots. This hotspot list may include various types of information for each of the hotspots, such as a respective location of each of the designated hotspots, and one or more corresponding location-based gaming features associated with each of the designated hotspots on the designated hotspot list. Additional information that may be stored for each designated hotspot can include, as some non-limiting examples, the name of a business or other entity sponsoring that hotspot, a business identifier (e.g., a tax ID), other corporate information for a sponsoring business entity (e.g., parent/subsidiary information, state of incorporation, contact information), a Media Access Control (MAC) address, etc. The designated hotspot list may be generated internally (e.g., via a gaming system operator) or, in some optional configurations, can be imported in whole or in part from a third party vendor.

In accord with some preferred embodiments, the method 500 also includes at block 507 providing to the user a dedicated, standalone mobile software application that is operable to be downloaded onto the user's mobile computing device. The mobile software application (or "app") runs on the user's mobile computing device (as opposed to a mobile website which is disseminated through an internet browser) and can be configured to operate in conjunction with the gaming system servers and a tracking system, as will be explained in further detail below, to track the movement of the mobile computing device and automatically trigger location-based gaming features associated with designated hotspots visited by the user, as explained above. Users can retrieve the app, for example, from a host website (e.g., the gaming operator's website), a third-party website (e.g., an "app store"), an email or similar electronic communication from the gaming operator, etc. Once retrieved and downloaded to the user's mobile computing device, the app can be linked to the user's player account. In this regard, the user's player account information may be provided when installing the mobile app.

The dedicated, standalone mobile software application may be provided with various optional functions and features. For instance, the mobile app can be configured to display on a display of the mobile computing device information related to a designated hotspot location and the location-based gaming feature associated with the designated hotspot location. One option may be to provide this information through a help menu or other user-selectable function. As another option, the mobile app can generate a push notification when the user is approaching a designated hotspot location. The push notification, which can be displayed by the mobile device even if the app itself is not open at that time, can include, for example, the name of the hotspot, the address/location of the hotspot, the distance from the user to the designated hotspot location, the types of location-based gaming feature(s) available at that hotspot location, user restrictions associated with that hotspot location, promotional materials of a business entity sponsoring that hotspot (e.g., logos, coupons, advertisements), etc. The app may also include user-selectable dropdown menus, popup windows, and the like, from which the user can retrieve additional information related to the location-based gaming features, such as the information stored in the hotspot list discussed hereinabove.

The dedicated, standalone mobile software application can also be configured to display on a display of the mobile computing device a map of all designated hotspot locations within a predetermined proximity of the physical location of the mobile computing device. For example, the map may look similar to what is shown in the top-half of FIG. 5 (e.g., above the network "cloud" 222), with a symbol, avatar or icon which is representative of the user and the user's movement, buildings and other geographic landmarks around the user, and indicators (e.g., pins or circles) that represent designated local hotspots within, for example, one mile of the user's current location. The map may also offer user-selectable options to view hotspots outside of the predetermined proximity, to acquire directions to a designated hotspot location, to view traffic conditions around a designated hotspot location, to acquire public transportation options to a designated hotspot location, singly or in any combination. In some embodiments, the user's movement can be shown in real time by repositioning the user's icon/avatar on the map.

The dedicated, standalone mobile software application can also be configured to provide the user with various other user-selectable options. The mobile app, for example, can be configured to display on a display of the mobile computing device other types of information, such as a user history which lists all or at least the most recent hotspot location or locations visited by the user. The mobile app can also, or alternatively, display all of the location-based gaming features and/or the awards resulting therefrom which were accumulated as a result of the user visiting those designated hotspot locations. It may be desirable that the mobile app be operable to display at least those location-based gaming features with awards/benefits that the user has yet to redeem. The mobile software application can be further configured to display a randomly determined outcome associated with each play of a wagering game that is triggered, in whole or in part, by a location-based gaming feature. In this regard, the mobile app can provide the user with a redemption option with which the user can redeem any awards associated with winning outcomes in the aforementioned play(s) of the wagering game.

At block 509, the method includes determining the physical location of the user via the user's mobile computing device. In some embodiments, the gaming system servers are operable to make this determination while, in some embodiments, the gaming system receives an indication of the physical location of the mobile computing device from an outside source, and while, in other embodiments, the gaming system employs a combination thereof. Location and movement of the mobile computing device can be determined through any of the means discussed above, for example, in the explanation of the gaming system and network 200. The physical location and/or movement of the mobile computing device can be determined, for example, using GPS technology, trilateration techniques, triangulation of a signal output by the mobile computing device, a comparison of a signal output by the mobile computing device between at least two different receivers, an RFID tag, an NFC tag, a short range wireless connection between the mobile computing device and a stationary receiver, or a short range wireless connection between the mobile computing device and a mobile receiver, or any combination thereof.

The method 500 continues to block 511 where it is determined if the physical location of the mobile computing device corresponds to or is within a predetermined proximity of at least one of the designated hotspot locations. As indicated above in the discussion of the gaming system 300 of FIG. 6, the user's mobile computing device need not be within the area defined as the hotspot location to trigger a corresponding location-based gaming feature. Where the designated hotspot location is located inside a brick-and-mortar store or building, for example, the user and the user's mobile device do not have to be physically inside the building/store of a business entity associated with that hotspot location to trigger a corresponding location-based gaming feature. Rather, these location-based gaming features are available if the physical location of the mobile computing device corresponds to or is within a predetermined range or proximity of a designated hotspot location.

Optionally, block 511 also includes validating that any prerequisite trigger criteria have been satisfied before automatically triggering any of the location-based gaming features. By way of example, and not limitation, a system server can first conduct a backend check to confirm the user has a player account, to confirm the mobile device being used to trigger the location-based gaming feature is associated with the user and/or the user's player account, to confirm the user's current physical location, and/or to determine if the user is eligible for the location-based gaming feature at a particular hotspot. In some embodiments, a location-based gaming feature may be subject to certain user restrictions. For example, there may be time-limit restrictions where the user's mobile computing device must be physically located at or within a proximity of the designated hotspot location for at least a predetermined minimum period of time before a location-based gaming feature is triggered. Other restrictions may require the user to physically check in at a particular hotspot location or group of locations before a location-based gaming feature is triggered. In some embodiments, a user's eligibility to trigger a location-based gaming feature may depend on that user's status with a particular sponsor business entity or with a particular gaming operator (e.g., through player tracking, the user must have achieved a threshold player status at a specific casino). There may be use restrictions which limit the number of times a location-based gaming feature can be triggered by a particular user or limit the number of times a location-based gaming feature can be triggered by a particular user in a given period of time. The user may also be penalized for violating restrictions. For instance, if a user stays at a particular hotspot location for longer than an allotted amount of time, the user may incur some sort of negative aspect (e.g., lose one or more of the awards won as a result of triggered location-based gaming features). These limits can be configurable by the operator.

If the physical location of the user's mobile computing device corresponds to or is within a predetermined proximity of at least one of the designated hotspot locations, the method 500 responds at step 513 by determining which location-based gaming feature or features are associated with that designated hotspot location, and then automatically triggering, without any input from the user, one or more of the location-based gaming features corresponding to the designated hotspot location. In effect, for a location-based gaming feature to be triggered, the user is not required to be operating the mobile device, to place a wager, to initiate play through a key, button or lever, or even be aware that a location-based gaming feature is in fact being triggered. In this regard, the mobile app on the user's mobile computing device not need be "open" (e.g., enabled by the user) in order to trigger the location-based gaming feature. Rather, in some embodiments, the app could actually be enabled by the hotspot, for example, by a backend server through the mobile device's exchange with a Wi-Fi connection at the hotspot. In some embodiments, the user and device can be identified by the backend server via the device's serial number or Internet Protocol (IP) address through exchange of an NFC or RFID tag. The app could also be encoded with a background process that runs even when the app is closed such that the app, device, and/or user can be identified at a designated hotspot location. It may be desirable to automate the game play in the above manner so that the user is not required to operate their mobile device, open their app, or remember to check in at each designated hotspot location they visit.

Automatically triggering the location-based gaming feature includes initiating play of at least a portion of a wagering game. In this regard, triggering a location-based gaming feature may operate to provide the user with a randomly determined outcome or a portion of a randomly determined outcome of the wagering game. Block 513 may therefore include randomly determining an outcome or portion of an outcome of a base-game segment of a wagering game. This may include an RNG generating a random number, game logic for determining the outcome based on the randomly generated number, and a CPU operating to execute a wagering game program, and game assets (e.g., art, sound, etc.) for presenting the determined outcome to a user in a visual manner. The base-game outcome of the wagering game can be visually represented by a plurality of symbols arranged on a display of the mobile computing device. For some preferred implementations, the wagering game is a slot game (also known as a "reel" game), and the location-based gaming feature is a reel-spin-triggering event for the slot game. When the user, and thus the user's mobile computing device, is physically located at or is determined to be within a predetermined proximity of a designated hotspot location, the reel-spin-triggering event operates to automatically vary (e.g., spin and stop) one or more of the reels of the slot-type wagering game for the user.

Block 515 of FIG. 1 includes generating or otherwise outputting a notification to the user of the mobile computing device that the location-based gaming feature was automatically triggered. The notification may take on any known form, such as a page, an email, an SMS text message, or a push notification. In some embodiments, the user's mobile computing device, through operation of the mobile app downloaded thereto, will generate an audible and/or visual communication informing the user of the triggered location-based gaming feature. For other implementations, an output device, such as an audio speaker or a display screen, at the designated hotspot location will output the notification to the user.

Responsive to this notification, or at the user's own initiative, the user then requests to view the play of the wagering game (or the portion thereof) that was initiated through the automatic triggering of the location-based gaming feature. For example, at block 517, the method 500 includes receiving a redemption input from the user to view the randomly determined outcome of the play of the wagering game and to redeem any awards associated therewith. The redemption input may be submitted through a variety of mediums, such as the mobile app on the user's mobile computing device, via a website hosted by the gaming system, or any other available input device. For some implementations, or the redemption input may be submitted by the user visiting a store (e.g., a store of a sponsor business) or other brick-and-mortar establishment (e.g., a casino). Block 517 may therefore also include displaying the randomly determined base-game outcome to the user. Some implementations may in fact require the user to interact with the mobile app in order to redeem any awards or benefits resulting from this game play. For instance, to view and redeem any game play accrued through triggering of a location-based gaming feature (e.g., a number of free spins in a slot game), the user may be required to open the app, which may be configured as a standalone app on the mobile device, and play each of the free spins on the mobile app. Optionally, if the user opens the mobile app after the location-based gaming feature is triggered, and then interacts with a particular aspect of the app (e.g., the user uses the app to check in on FACEBOOK® and post their play activity to the social networking website), the user can be awarded with additional benefits. In some embodiments, a user may be required to visit a particular gaming establishment (e.g., a "brick-and-mortar" casino) or a particular website (e.g., a "virtual" casino or a sponsor's host website) to view the game play and/or redeem any awards or benefits resulting from this game play. Doing so may optionally enable game play not otherwise available to that user or other players at a particular terminal or a particular bank of terminals at the casino. In some embodiments, the outcome of a reel-spin event triggered by a location-based gaming feature can determine a user's placement on a leader board at a designated hotspot location associated with that location-based gaming feature. In this regard, the more frequently a user visits a particular hotspot location and/or stays at that particular hotspot location, the greater the number of times a location-based gaming feature can be triggered and, thus, the more likely the user will ascend on the leader board. By reaching the top of the leader board, a user can be declared "king" of that designated hotspot location, which can translate into increased awards and/or benefits. For some implementations, staying at the top of the leader board could then translate into secondary opportunities, additional awards and/or benefits.

The location-based gaming features disclosed herein can be employed to influence or manipulate user behavior—i.e., used to drive certain behavior, used as a motivational tool to alter behavior, or used as a deterrent to discourage or disincentivize a certain behavior. For instance, a user can be induced to visit a specific establishment, to stay at a particular establishment, or to relocate to a different establishment by offering the user certain incentives, such as the ability to play a game feature for free, by offering the ability to play games, game content or other features that they may not otherwise be eligible to play, or by offering the ability to win larger or more attractive awards associated with the feature. As one example, a user may be deterred from staying at a particular establishment for too long (e.g., for more than one hour) because they will be penalized with a loss of an accrued award and/or benefit. On the other hand, the user may be incentivized to stay at a particular establishment for a longer period of time (e.g., for at least one hour) because they will be awarded with additional awards and/or benefits. These concepts can also be applied to group gameplay. For example, the above concepts can be employed to ensure that a group or users stays and moves together as a group, or to ensure that the users stay close enough together to pass features back-and-forth between the users (e.g., in a "hot potato" game configuration which requires such interplay).

Another concept related to location-based gaming features that are triggered by the movement of users is an individual or group game wherein players are required to search for and "find" various objects, akin to a treasure hunt or scavenger hunt. Such game play may comprise a wagering game or a non-wagering activity (e.g., tying a nominal benefit to an introductory activity that would acquaint a person with the various areas and offerings of a gaming establishment). In association with a wagering game, at least one aspect of this concept requires a player to visit, within a predetermined period of time (e.g., seconds, minutes, hours), one or more predetermined designated hotspot locations. In variations on the scavenger hunt concept, players are required to walk around from location to location and collect things or find people and collect things from those people. For example, a player may be required to actually meet an employee who will then deposit a confirmation of the contact in the users mobile device.

In some embodiments, the method 500 includes at least those steps enumerated above. It is also within the scope and spirit of the present invention to omit steps, include additional steps, and/or modify the order presented above. It should be further noted that the method 500 can be representative of a single play of a wagering game. However, it is expected that the method 500 be applied in a systematic and repetitive manner. Additional information regarding location-based gaming can be found, for example, in commonly owned U.S. Pat. No. 8,282,490 B2, to Vladimir I. Arezina et al., which issued on Oct. 9, 2012, and is incorporated herein by reference in its entirety and for all purposes.

Aspects of this disclosure can be implemented, in some embodiments, through a computer-executable program of instructions, such as program modules, generally referred to as software applications or application programs executed by a computer. The software can include, in non-limiting examples, routines, programs, objects, components, and data structures that perform particular tasks or implement particular abstract data types. The software can form an interface to allow a computer to react according to a source of input. The software can also cooperate with other code segments to initiate a variety of tasks in response to data received in conjunction with the source of the received data. The software can be stored on any of a variety of memory media, such as CD-ROM, magnetic disk, bubble memory, and semiconductor memory (e.g., various types of RAM or ROM).

Moreover, aspects of the present disclosure can be practiced with a variety of computer-system and computer-network configurations, including hand-held devices, multiprocessor systems, microprocessor-based or programmable-consumer electronics, minicomputers, mainframe computers, and the like. In addition, aspects of the present disclosure can be practiced in distributed-computing environments where tasks are performed by remote-processing devices that are linked through a communications network. In a distributed-computing environment, program modules can be located in both local and remote computer-storage media including memory storage devices. Aspects of the present disclosure can therefore, be implemented in connection with various hardware, software or a combination thereof, in a computer system or other processing system.

Any of the methods described herein can include machine readable instructions for execution by: (a) a processor, (b) a controller, and/or (c) any other suitable processing device. Any algorithm, software, or method disclosed herein can be embodied in software stored on a tangible medium such as, for example, a flash memory, a CD-ROM, a floppy disk, a hard drive, a digital versatile disk (DVD), or other memory devices, but persons of ordinary skill in the art will readily appreciate that the entire algorithm and/or parts thereof could alternatively be executed by a device other than a controller and/or embodied in firmware or dedicated hardware in a well known manner (e.g., it can be implemented by an application specific integrated circuit (ASIC), a programmable logic device (PLD), a field programmable logic device (FPLD), discrete logic, etc.). Also, some or all of the machine readable instructions represented in any flowchart depicted herein can be implemented manually. Further, although specific algorithms are described with reference to flowcharts depicted herein, persons of ordinary skill in the art will readily appreciate that many other methods of implementing the example machine readable instructions can alternatively be used. For example, the order of execution of the blocks can be changed, and/or some of the blocks described can be changed, eliminated, or combined.

It should be noted that the algorithms illustrated and discussed herein as having various modules or blocks or steps that perform particular functions and interact with one another are provided purely for the sake of illustration and explanation. It should be understood that these modules are merely segregated based on their function for the sake of description and represent computer hardware and/or executable software code which can be stored on a computer-readable medium for execution on appropriate computing hardware. The various functions of the different modules and units can be combined or segregated as hardware and/or software stored on a non-transitory computer-readable medium as above as modules in any manner, and can be used separately or in combination.

While many embodiments and modes for carrying out the present invention have been described in detail above, those familiar with the art to which this invention relates will recognize various alternative designs and embodiments for practicing the invention within the scope of the appended claims.

What is claimed is:

1. A gaming system for conducting a wagering game with a mobile computing device, the mobile computing device being configured to wirelessly communicate information with the gaming system via a network, the gaming system comprising:

one or more processors; and one or more memory devices storing instructions that, when executed by at least one of the one or more processors, cause the gaming system to:

receive an indication of a physical location of the mobile computing device;

determine if the physical location of the mobile computing device corresponds to or is within a predetermined proximity of a designated hotspot location; and responsive to the physical location of the mobile computing device corresponding to or being within the predetermined proximity of the designated hotspot location, determine a location-based gaming feature associated with the designated hotspot location and automatically trigger the location-based gaming feature without requiring an input from a user of the mobile computing device, wherein automatically triggering the location-based gaming feature includes initiating play of at least a portion of the wagering game.

2. The gaming system of claim 1, wherein the one or more memory devices store additional instructions that cause the gaming system to communicate to the mobile computing device a dedicated, standalone mobile software application for the mobile computing device.

3. The gaming system of claim 2, wherein the dedicated, standalone mobile software application is configured to display on a display of the mobile computing device information related to the designated hotspot location and the location-based gaming feature associated with the designated hotspot location.

4. The gaming system of claim 2, wherein the dedicated, standalone mobile software application is configured to display on a display of the mobile computing device a map of all designated hotspot locations within a predetermined proximity of the physical location of the mobile computing device.

5. The gaming system of claim 2, wherein the dedicated, standalone mobile software application is configured to display on a display of the mobile computing device a history of hotspot locations visited by the user or the location-based gaming features accumulated as a result of the user visiting those designated hotspot locations, or both.

6. The gaming system of claim 2, wherein the mobile software application is configured to display on a display of the mobile computing device a randomly determined outcome of the play of the wagering game and to redeem any awards associated therewith.

7. The gaming system of claim 1, wherein the one or more memory devices store additional instructions that cause the gaming system to save in a database a list of designated hotspots, a respective location of each of the designated hotspots, and one or more corresponding location-based gaming features associated with each hotspot on the list of designated hotspots.

8. The gaming system of claim 1, wherein the one or more memory devices store additional instructions that cause the gaming system to receive an input from the user of the mobile computing device to view a randomly determined outcome of the play of the wagering game and to redeem any awards associated therewith.

9. The gaming system of claim 1, wherein the one or more memory devices store additional instructions that cause the gaming system to receive requisite player information to create a player account associated with the user of the mobile computing device.

10. The gaming system of claim 9, wherein the one or more memory devices store additional instructions that cause the gaming system, responsive to receiving the requisite player information, to create a player account and store in a database the player account associated with an indicator of the mobile computing device.

11. The gaming system of claim 1, wherein the one or more memory devices store additional instructions that cause the gaming system to output a notification to the user of the mobile computing device that the location-based gaming feature was automatically triggered.

12. The gaming system of claim 1, wherein the wagering game is a slot game, and the location-based gaming feature is a reel-spin-triggering event for the slot game.

13. The gaming system of claim 1, wherein the designated hotspot location is associated with a business entity, and wherein at least a portion of the location-based gaming feature is sponsored by the business entity.

14. The gaming system of claim 1, wherein the physical location of the mobile computing device is determined using at least one of a global positioning system, triangulation of a signal output by the mobile computing device, a comparison of a signal output by the mobile computing device between at least two different receivers, an RFID tag, an NFC tag, a short range wireless connection between the mobile computing device and a stationary receiver, or a short range wireless connection between the mobile computing device and a mobile receiver.

15. One or more physical non-transitory computer-readable storage media including instructions which, when executed by one or more processors, cause the one or more processors to perform operations comprising:

receive an indication of a physical location of a mobile computing device configured to wirelessly communicate information with a gaming system configured to conduct a wagering game;

determine if the physical location of the mobile computing device corresponds to or is within a predetermined proximity of a designated hotspot location; and responsive to the physical location of the mobile computing device corresponding to or being within the predetermined proximity of the designated hotspot location:

determine a location-based gaming feature associated with the designated hotspot location, and automatically trigger the location-based gaming feature without requiring an input from a user of the mobile computing device, the automatically triggering the location-based gaming feature including initiating play of at least a portion of the wagering game.

16. A computer-implemented method of conducting a wagering game with a mobile computing device configured to wirelessly communicate information with a gaming system, the method comprising:

receiving an indication of a physical location of the mobile computing device;

determining if the physical location of the mobile computing device corresponds to or is within a predetermined proximity of a designated hotspot location; and responsive to the physical location of the mobile computing device corresponding to or being within the predetermined proximity of the designated hotspot location:

determining a location-based gaming feature associated with the designated hotspot location, and automatically triggering the location-based gaming feature without requiring an input from a user of the mobile computing device, the automatically triggering the location-based gaming feature including initiating play of at least a portion of the wagering game.

17. The method of claim 16, further comprising communicating to the mobile computing device a dedicated, standalone mobile software application for the mobile computing device, wherein the dedicated, standalone mobile software application is configured to display on a display of the mobile computing device information related to the designated hotspot location and the location-based gaming feature associated with the designated hotspot location.

18. The method of claim 16, further comprising communicating to the mobile computing device a dedicated, standalone mobile software application for the mobile computing device, wherein the dedicated, standalone mobile software application is further configured to display on a display of the mobile computing device a map of all designated hotspot locations within a predetermined proximity of the physical location of the mobile computing device.

19. The method of claim 16, further comprising communicating to the mobile computing device a dedicated, standalone mobile software application for the mobile computing device, wherein the dedicated, standalone mobile software application is further configured to display on a display of the mobile computing device a history of hotspot locations visited by the user or the location-based gaming features accumulated as a result of the user visiting those designated hotspot locations, or both.

20. The method of claim 16, further comprising communicating to the mobile computing device a dedicated, standalone mobile software application for the mobile computing device, wherein the mobile software application is further configured to display on a display of the mobile computing device a randomly determined outcome of the play of the wagering game and redeem any awards associated therewith.

* * * * *